US009926941B2

(12) United States Patent
V et al.

(10) Patent No.: US 9,926,941 B2
(45) Date of Patent: Mar. 27, 2018

(54) TURBOCHARGER CENTER HOUSING

(71) Applicant: Honeywell International Inc., Morristown, NJ (US)

(72) Inventors: Santosh V, Hyderabad (IN); Suryakant Gupta, Varanasi (IN); Parikshit I Mulani, Pune (IN); Poomkuzhimannil Zachariah John, Bangalore (IN); Sunil Dayalan, Chennai (IN); Maltesh Kolur, Bangalore (IN); Prithivi Karthikeyan, Bangalore (IN); Chris Groves, Domevre sur Durbion (FR); Peter Davies, Grandvillers (FR); Mark Groskreutz, Torrance, CA (US)

(73) Assignee: Honeywell International Inc., Morris Plains, NJ (US)

( * ) Notice: Subject to any disclaimer, the term of this patent is extended or adjusted under 35 U.S.C. 154(b) by 677 days.

(21) Appl. No.: 14/109,140

(22) Filed: Dec. 17, 2013

(65) Prior Publication Data

US 2015/0167690 A1 Jun. 18, 2015

(51) Int. Cl.
*F04D 29/40* (2006.01)
*F04D 29/42* (2006.01)
(Continued)

(52) U.S. Cl.
CPC ..... *F04D 29/403* (2013.01); *F01D 25/162* (2013.01); *F01D 25/186* (2013.01);
(Continued)

(58) Field of Classification Search
CPC .. F04D 29/403; F04D 29/4206; F04D 29/624; F01D 25/162; F01D 25/186;
(Continued)

(56) References Cited

U.S. PATENT DOCUMENTS 4,268,229 A * 5/1981 Berg ..... F01D 11/00 415/111
5,560,207 A 10/1996 Ramsden et al.
(Continued)

FOREIGN PATENT DOCUMENTS

DE 4330380 A1 * 3/1995
EP 0781908 A2 7/1997
(Continued)

OTHER PUBLICATIONS

Translation of DE 4330380 A1, EPO, retrieved Mar. 13, 2017.*
EPO European Search and European Search Opinion, EP 141939569.5-1610, dated Sep. 18, 2015 (6 pages).

*Primary Examiner* — Woody Lee, Jr.
*Assistant Examiner* — Jesse Prager
(74) *Attorney, Agent, or Firm* — Brian J. Pangrle

(57) ABSTRACT

An assembly can include a compressor backplate; a bearing boss that extends axially from the compressor backplate and that includes an outer surface and male coupling features disposed along the outer surface; and a casing that includes a compressor end, a bearing boss opening at the compressor end, a turbine end, an inner surface located between the compressor end and the turbine end and female coupling features disposed along a portion of the inner surface, the male coupling features and the female coupling features configured to couple the bearing boss to the casing. Various other examples of devices, assemblies, systems, methods, etc., are also disclosed.

18 Claims, 14 Drawing Sheets

(51) Int. Cl.

| | |
|---|---|
| ***F04D 29/62*** | (2006.01) |
| ***F01D 25/24*** | (2006.01) |
| ***F01D 25/16*** | (2006.01) |
| ***F01D 25/18*** | (2006.01) |
| ***F02B 39/14*** | (2006.01) |

(52) U.S. Cl.
CPC ..... *F01D 25/243* (2013.01); *F02B 39/14* (2013.01); *F04D 29/4206* (2013.01); *F04D 29/624* (2013.01); *F05D 2220/40* (2013.01); *F05D 2250/281* (2013.01); *Y10T 29/49236* (2015.01)

(58) Field of Classification Search
CPC ..... F01D 25/243; Y10T 29/49236; Y10T 29/4932; F05D 2220/40; F05D 2250/281; F05D 2230/51; F05D 2230/52; F02C 6/12; F02B 39/14
See application file for complete search history.

(56) References Cited

U.S. PATENT DOCUMENTS 5,692,378 A * 12/1997 Ramsden ..... F02B 37/007 60/612
5,993,173 A * 11/1999 Koike ..... F01D 25/166 417/407
2011/0200422 A1* 8/2011 Gutknecht ..... F01D 25/16 415/1
2012/0014782 A1* 1/2012 Petitjean ..... F01D 25/14 415/170.1
2013/0089407 A1* 4/2013 Ranz ..... F01D 25/162 415/1
2013/0149126 A1* 6/2013 Herrera Celaya .... F02B 37/183 415/200
2013/0247566 A1* 9/2013 Lombard ..... F02F 1/243 60/605.1
2013/0269339 A1 10/2013 Marques et al.
2015/0056065 A1* 2/2015 Takama ..... F01D 25/166 415/119

FOREIGN PATENT DOCUMENTS

| | | | |
|---|---|---|---|
| EP | 0794319 | A1 | 9/1997 |
| WO | 2012087907 | A2 | 6/2012 |
| WO | 2013085766 | A1 | 6/2013 |

* cited by examiner

TURBOCHARGER CENTER HOUSING

TECHNICAL FIELD

Subject matter disclosed herein relates generally to turbomachinery for internal combustion engines and, in particular, to housings.

BACKGROUND

A turbocharger may include a center housing disposed between a compressor housing and a turbine housing where the center housing supports a bearing or bearings for rotation of turbocharger shaft operatively coupled to a turbine wheel housed by the turbine housing and a compressor wheel housed by the compressor housing. In operation, such a turbocharger can extract energy from the flow of high temperature exhaust from an internal combustion engine to compress intake air for the internal combustion engine.

As an example, a center housing may be formed as a unitary piece, for example, using a casting process followed by a machining process. A casting process may involve providing an assembled multi-piece core about which a center housing is cast using a mold (e.g., a cast). In such an example, the mold may be formed from compacted sand contained in a mold box where the compacted sand forms the outer surfaces of a component shape. As an example, a core may be positioned in a mold (e.g., within a shape formed by the compacted sand). To form a cast component, a mold may be filled with material such as molten metal or alloy, which may flow to spaces between compacted sand and a core, if present. After hardening of the fill material, a mold box may be opened and the compacted sand removed to reveal the cast component. Where a core is present, it may then be removed from the cast component, for example, as part of a de-coring process. Various issues exist for center housings formed as a unitary piece by casting. For example, debris may be trapped in regions difficult to access or inspect (e.g., regions formed via the core). Machining may also be complicated or otherwise limited, especially as to regions formed using a core or cores. Such manufacturing related issues may have an impact on turbocharger operation.

Various aspects of turbocharger operation may be affected by temperature. For example, where a bearing or bearings are lubricated by lubricant, high temperatures in a center housing may cause lubricant degradation, coking, deposit formation, etc. As another example, heat soak back from a turbine side to a compressor side can add to the increase in intake air temperature caused by compression, which may correspondingly increase load of a charge air cooler. As to the aforementioned unitary piece center housing, as a result of manufacture, traps may exist that act to collect lubricant where time and temperature may result in coking. Further, being a unitary piece, conduction of heat energy may readily occur from a turbine side to a compressor side of the center housing, which may act to elevate temperature in a bearing and shaft system.

Various examples of turbocharger components, assemblies, etc. are described herein that may, as an example, facilitate manufacture, reduce heat soak back during operation and increase performance.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Figure 1:
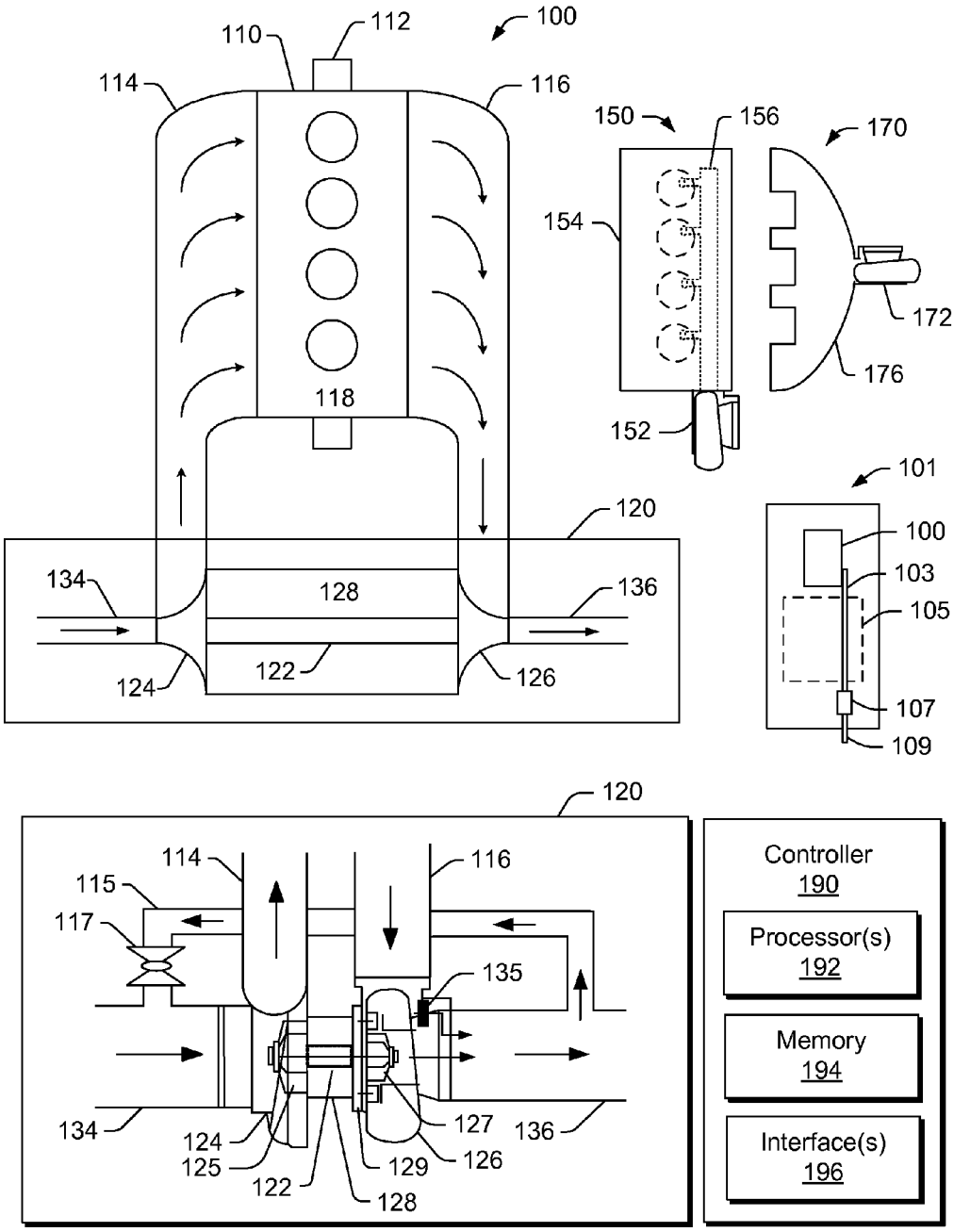
FIG. 1 is a diagram of a turbocharger and an internal combustion engine along with a controller.

Turbochargers are frequently utilized to increase output of an internal combustion engine. Referring to FIG. 1, as an example, a system 100 can include an internal combustion engine 110 and a turbocharger 120. As shown in FIG. 1, the system 100 may be part of a vehicle 101 where the system 100 is disposed in an engine compartment and connected to an exhaust conduit 103 that directs exhaust to an exhaust outlet 109, for example, located behind a passenger compartment 105. In the example of FIG. 1, a treatment unit 107 may be provided to treat exhaust (e.g., to reduce emissions via catalytic conversion of molecules, etc.).

As shown in FIG. 1, the internal combustion engine 110 includes an engine block 118 housing one or more combustion chambers that operatively drive a shaft 112 (e.g., via pistons) as well as an intake port 114 that provides a flow path for air to the engine block 118 and an exhaust port 116 that provides a flow path for exhaust from the engine block 118.

The turbocharger 120 can act to extract energy from the exhaust and to provide energy to intake air, which may be combined with fuel to form combustion gas. As shown in FIG. 1, the turbocharger 120 includes an air inlet 134, a shaft 122, a compressor housing assembly 124 for a compressor wheel 125, a turbine housing assembly 126 for a turbine wheel 127, another housing assembly 128 and an exhaust outlet 136. The housing 128 may be referred to as a center housing assembly as it is disposed between the compressor housing assembly 124 and the turbine housing assembly 126. The shaft 122 may be a shaft assembly that includes a variety of components. The shaft 122 may be rotatably supported by a bearing system (e.g., journal bearing(s), rolling element bearing(s), etc.) disposed in the housing assembly 128 (e.g., in a bore defined by one or more bore walls) such that rotation of the turbine wheel 127 causes rotation of the compressor wheel 125 (e.g., as rotatably coupled by the shaft 122). As an example a center housing rotating assembly (CHRA) can include the compressor wheel 125, the turbine wheel 127, the shaft 122, the housing assembly 128 and various other components (e.g., a compressor side plate disposed at an axial location between the compressor wheel 125 and the housing assembly 128).

In the example of FIG. 1, a variable geometry assembly 129 is shown as being, in part, disposed between the housing assembly 128 and the housing assembly 126. Such a variable geometry assembly may include vanes or other components to vary geometry of passages that lead to a turbine wheel space in the turbine housing assembly 126. As an example, a variable geometry compressor assembly may be provided.

In the example of FIG. 1, a wastegate valve (or simply wastegate) 135 is positioned proximate to an exhaust inlet of the turbine housing assembly 126. The wastegate valve 135 can be controlled to allow at least some exhaust from the exhaust port 116 to bypass the turbine wheel 127. Various wastegates, wastegate components, etc., may be applied to a conventional fixed nozzle turbine, a fixed-vaned nozzle turbine, a variable nozzle turbine, a twin scroll turbocharger, etc.

In the example of FIG. 1, an exhaust gas recirculation (EGR) conduit 115 is also shown, which may be provided, optionally with one or more valves 117, for example, to allow exhaust to flow to a position upstream the compressor wheel 125.

FIG. 1 also shows an example arrangement 150 for flow of exhaust to an exhaust turbine housing assembly 152 and another example arrangement 170 for flow of exhaust to an exhaust turbine housing assembly 172. In the arrangement 150, a cylinder head 154 includes passages 156 within to direct exhaust from cylinders to the turbine housing assembly 152 while in the arrangement 170, a manifold 176 provides for mounting of the turbine housing assembly 172, for example, without any separate, intermediate length of exhaust piping. In the example arrangements 150 and 170, the turbine housing assemblies 152 and 172 may be configured for use with a wastegate, variable geometry assembly, etc.

In FIG. 1, an example of a controller 190 is shown as including one or more processors 192, memory 194 and one or more interfaces 196. Such a controller may include circuitry such as circuitry of an engine control unit (ECU). As described herein, various methods or techniques may optionally be implemented in conjunction with a controller, for example, through control logic. Control logic may depend on one or more engine operating conditions (e.g., turbo rpm, engine rpm, temperature, load, lubricant, cooling, etc.). For example, sensors may transmit information to the controller 190 via the one or more interfaces 196. Control logic may rely on such information and, in turn, the controller 190 may output control signals to control engine operation. The controller 190 may be configured to control lubricant flow, temperature, a variable geometry assembly (e.g., variable geometry compressor or turbine), a wastegate (e.g., via an actuator), an electric motor, or one or more other components associated with an engine, a turbocharger (or turbochargers), etc. As an example, the turbocharger 120 may include one or more actuators and/or one or more sensors 198 that may be, for example, coupled to an interface or interfaces 196 of the controller 190.

Figure 2:
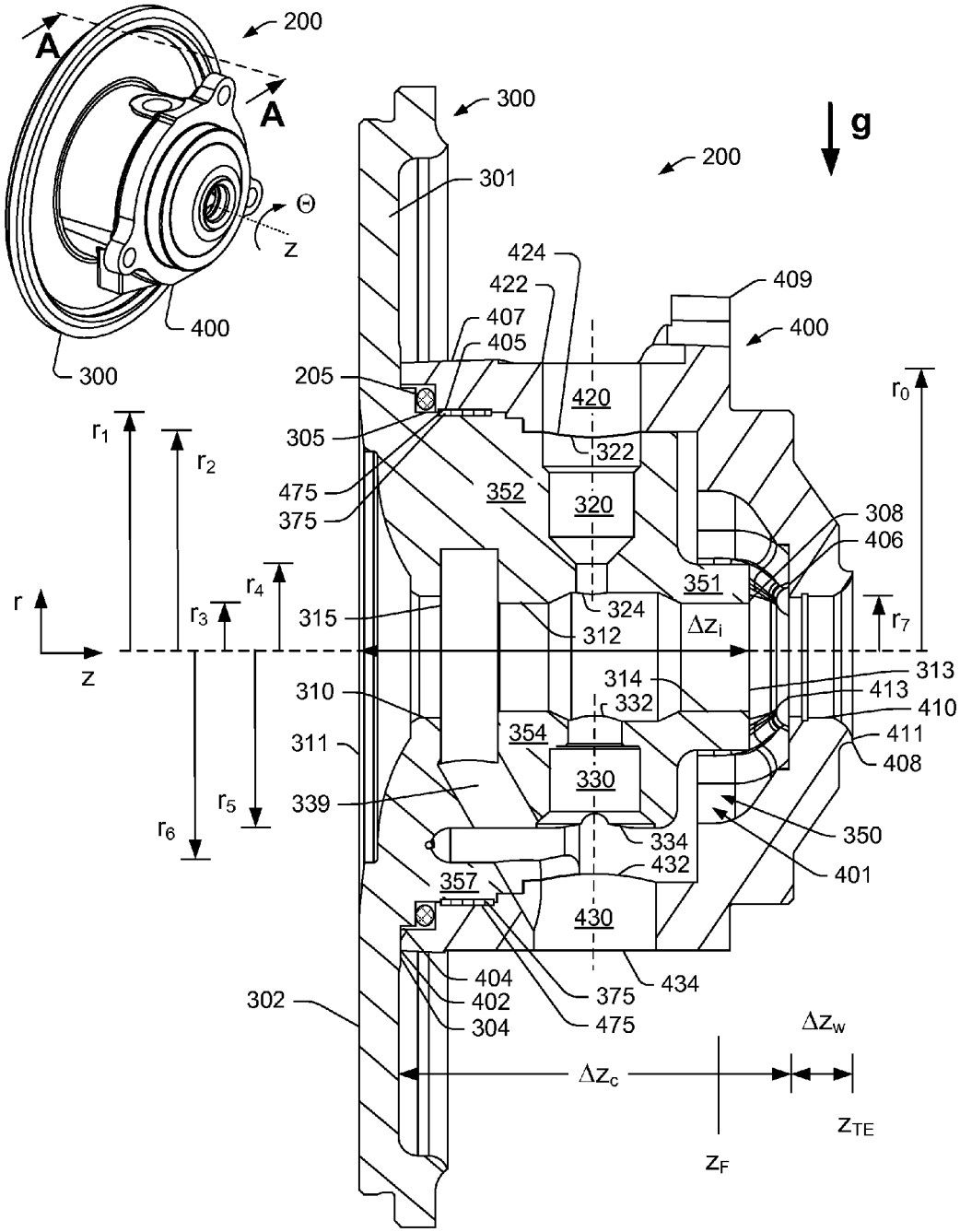
FIG. 2 is a perspective view of an example of a center housing and a cross-sectional view of the center housing along a line A-A.

FIG. 2 shows a perspective view of an example of a center housing 200 and a cutaway view of the center housing 200 along a line A-A. As described herein, various components may be shown with respect to a cylindrical coordinate system having an axial "z" coordinate, a radial "r" coordinate and an azimuthal "Θ" coordinate (see, e.g., z-axis, r-axis and azimuthal angle Θ direction). As an example, the center housing 200 may be oriented with respect to gravity (g), for example, for purposes of lubricant flow, settling of a shaft, etc.

As shown in the example of FIG. 2, the center housing 200 includes a component 300 and a casing 400. The component 300 includes a backplate 301 and a bearing boss 350 that extends axially from the backplate 301. As an example, the component 300 may be a unitary component or multiple components coupled together (e.g., consider the backplate 301 and the bearing boss 350 as separate components operatively coupled to form the component 300). As an example, the component 300 may be a cast, unitary component that may be subsequently machined prior to its assembly as part of the center housing 200. As an example, the casing 400 may be a unitary component or multiple components coupled together. As an example, the casing 400 may be cast as a unitary component that may be subsequently machined prior to its assembly as part of the center housing 200.

As shown in the example of FIG. 2, the backplate 301 of the component 300 includes a compressor side surface 302 and a turbine side surface 304 from which the bearing boss 350 extends axially outwardly therefrom (e.g., in a direction of the z-axis). The backplate 301 and the bearing boss 350 form a bore 310 with a bore opening 311 where the bore 310 includes surfaces 312 and 314 that may form clearances with a bearing disposed in the bore 310 (e.g., for lubricant film formation). As shown, the bore 310 extends from the opening 311 at the compressor side surface 302 to an opening 313 at a turbine side surface 308 of the bearing boss 350. As an example, the bore 310 may include an enlarged portion 315 that may provide for lubricant flow about a collar such as a thrust collar. For example, along the z-axis, an assembled turbocharger (e.g., or CHRA) may include a compressor wheel, a collar and a bearing. In such an example, the collar may be an "oil slinger", for example, where the collar includes features to direct lubricant radially outwardly (e.g., due to rotation of the collar).

In the example of FIG. 2, the bearing boss 350 includes wall portions 351, 352, 354 and 357. For example, the wall portion 351 forms bore surfaces 312 and 314 while the wall portion 352 forms a lubricant inlet passage 320 and the wall portion 354 forms a lubricant outlet passage 330. As shown, a radial gap exists between the wall portion 354 and the wall portion 357. In the example of FIG. 2, the bearing boss 350 includes an outer surface 305, for example, formed in part by the wall portion 352 and in part by the wall portion 357.

In the example of FIG. 2, the lubricant inlet passage 320 includes an inlet opening 322 and an outlet opening 324 that opens to the bore 310 and the lubricant outlet passage 330 includes an inlet opening 332 at the bore 310 and an outlet opening 334. Each of the passages 320 and 330 may be defined by a respective axis where, for example, they may align (e.g., a straight rod may be received by the passages 320 and 330).

As to the casing 400, it includes a compressor end 402 and a turbine end 408 with a cavity 401 formed therebetween for receipt of the bearing boss 350 via an opening 404 at the compressor end 402. As shown, the turbine end 408 includes a bore 410, for example, axially aligned with the bore 310 of the component 300, where the bore 410 extends between an opening 413 at an inner surface 406 and an opening 411 at the turbine end 408 of the casing 400.

In the example of FIG. 2, the casing 400 includes a lubricant inlet passage 420 and a lubricant outlet passage 430 where the lubricant inlet passage 420 includes an inlet opening 422 and an outlet opening 424 and where the lubricant outlet passage 430 includes an inlet opening 432 and an outlet opening 434. The casing 400 also includes an inner surface 405 and an outer surface 407 and optionally one or more flange features 409, for example, for mounting a turbine housing to the casing 400 (e.g., the feature 409 may be a turbine housing flange).

In an assembled state, the center housing 200 may include one or more seal components such as the seal component 205. As an example, the component 300 and the casing 400 may be coupled such that the compressor end 402 of the casing 400 abuts the turbine side surface 304 of the backplate 301 and, for example, such that a gap or clearance exists between the turbine side surface 308 of the bearing boss 350 and the inner surface 406 of the casing 400. Such a gap may act to reduce heat transfer from the casing 400 to the bearing bushing 350 of the component 300.

As shown, in an assembled state, the surface 305 of the component 300 and the inner surface 405 of the casing 400 may contact, optionally via threads or another coupling mechanism.

In an assembled state, the lubricant passages 320 and 420 may substantially align (e.g., along respective axes) and the lubricant passages 330 and 430 may substantially align (e.g., along respective axes). As an example, in an installed state (e.g., in an engine compartment), the lubricant passages 320, 330, 420 and 430 may be approximately aligned with gravity (g). In such a manner, lubricant may drain from the center housing 200 due to gravity.

As an example, lubricant may flow from the opening 313 at the turbine side surface 308 of the bearing boss 350 to the lubricant passage 430. As an example, the component 300 may include a lubricant passage 339 that is in fluid communication with the bore 310 (e.g., that may extend to the bore 310, to a feature of the bore 310, etc.). As shown, the lubricant passage 339 is formed by the wall portion 354 of the component 300 and includes an outlet opening between the wall portion 354 and the wall portion 357. Lubricant may flow in the lubricant passage 339 and to the lubricant passage 430. As an example, the lubricant passage 339 may provide for passage of lubricant slung by an oil slinger positioned with respect to the enlarged portion 315 of the bore 310.

In the example of FIG. 2, the center housing 200 may be formed by coupling the component 300 to the casing 400. For example, the bearing boss 350 of the component 300 may include coupling features 375 and the casing 400 may include coupling features 475. In such an example, the coupling features 375 may be male coupling features disposed along a portion of the surface 305 and the coupling features 475 may be female coupling features disposed along a portion of the inner surface 405. An assembly process may include rotating the component 300 with respect to the casing 400 (e.g., or vice versa) to join the component 300 and the casing 400 via their respective coupling features 375 and 475. For example, the coupling features 375 and 475 may be matching threads, matching bayonets, etc.

As shown in the example of FIG. 2, in an assembled state, various clearances exist within the center housing 200 between the component 300 and the casing 400. In particular, clearances exist about the bearing boss 350 and the casing 400 that may act to reduce heat transfer from the turbine end 408 of the casing 400 to the bearing boss 350 of the component 300 (e.g., reduce heat soak back).

Various radial dimensions are shown in FIG. 2 including a radius $r_0$ (e.g., for the surface 407), a radius $r_1$ (e.g., for the surface 305), a radius $r_2$ (e.g., for an interface between lubricant passages 420 and 320), a radius $r_3$ (e.g., for surfaces 312 and 314), a radius $r_4$ (e.g., for the wall portion 351 of the bearing boss 350), a radius $r_5$ (e.g., for the wall portion 354), a radius $r_6$ (e.g., for the wall portion 357) and a radius $r_7$ (e.g., for the bore 410). FIG. 2 also shows several axial dimensions, including $\Delta z_i$ as an axial length of the component 300, $\Delta z_c$ as an axial length of the cavity 401 and $\Delta z_w$ as an axial length of the bore 410 (e.g., a wall forming the bore 410). In the example of FIG. 2, the flange feature 409 may be located at an axial distance $z_F$, which may be inset from the turbine end 408 of the casing 400 (e.g., located at an axial distance $Z_{TE}$). In such an example, the turbine end 408 of the casing 400 may extend axially into a turbine housing (e.g., optionally into a variable geometry mechanism, etc. of a turbine housing assembly). Various dimensions shown in FIG. 2 may be further understood with respect to various views in FIG. 3 and FIG. 4.

As an example, an assembly can include a compressor backplate; a bearing boss that extends axially from the compressor backplate and that includes an outer surface and male coupling features disposed along the outer surface; and a casing that includes a compressor end, a bearing boss opening at the compressor end, a turbine end, an inner surface located between the compressor end and the turbine end and female coupling features disposed along a portion of the inner surface, the male coupling features and the female coupling features configured to couple the bearing boss to the casing.

As an example, the center housing 200 of FIG. 2 may be an assembly that includes the backplate 301 as a compressor backplate; the bearing boss 350 extending axially from the backplate 301 where the bearing boss 350 includes the outer surface 305 with the coupling features 375 as male coupling features; and the casing 400, which includes the compressor end 402, the bearing boss opening 404 at the compressor end 402, the turbine end 408, and the inner surface 405 as a surface located between the compressor end 402 and the turbine end 408 and the coupling features 475 as female coupling features disposed along a portion of the inner surface 405, the male coupling features 375 and the female coupling features 475 configured to couple the bearing boss 350 to the casing 400. As mentioned, in such an example, the backplate 301 and the bearing boss 350 may be a unitary component or, for example, two separate components joined together (e.g., via welding or other joining process).

Figure 3:
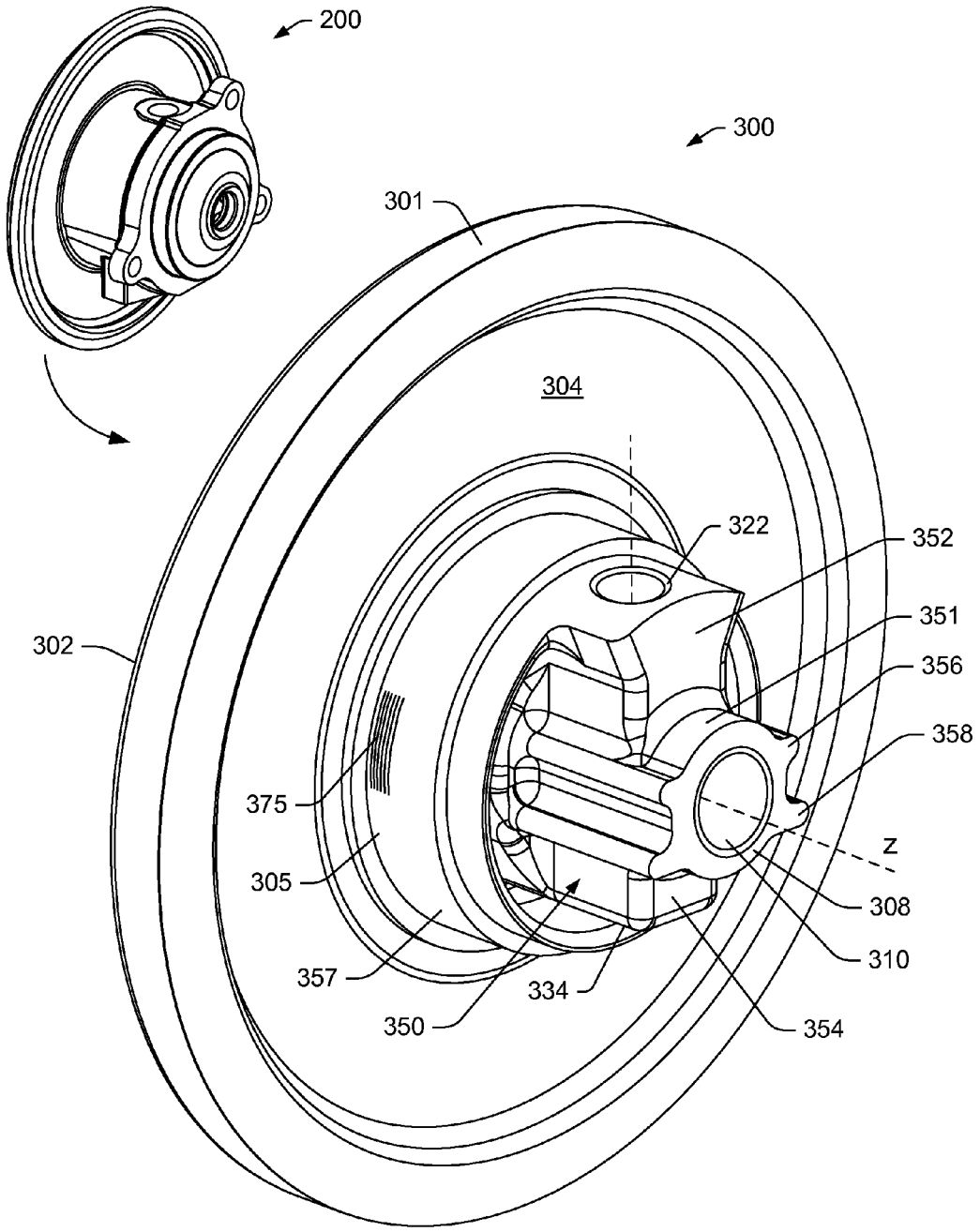
FIG. 3 is a perspective view of the center housing and a perspective view of an example of a backplate and bearing boss of the center housing.

FIG. 3 is a perspective view of the center housing 200 of FIG. 2 and a perspective view of an example of the component 300, as including the backplate 301 and bearing boss 350. In the example of FIG. 3, the bearing boss 350 is shown as including ribs 356 and 358 as extending from the wall portion 351. The ribs 356 and 358 may increase surface area of the bearing boss 350, for example, to enhance heat transfer. For example, during operation, a shaft supported by a bearing seated in the bearing boss 350 may generate heat energy (e.g., via frictional forces that may include viscous heating of lubricant). In such an example, lubricant may be supplied to the bore 310 via the lubricant inlet opening 322 and may exit the bore 310 via the lubricant outlet opening 334 where exiting lubricant may transport heat energy. However, as another transport mechanism, the ribs 356 and 358 may help to transfer heat energy away from the bearing boss 350 and to a clearance space that exists between the casing 400 and the bearing boss 350. Further, as an example, the clearance space (e.g., clearances) may also act to hinder transfer of heat energy from a turbine assembly to the bearing boss 350. As an example, the clearance space may be occupied in part by a medium such as air, which may act as an insulator (e.g., comparing conduction of heat energy in air to that of metal or alloy of the component 300 and/or the casing 400).

As an example, a bearing boss may include ribs that are oriented with respect to a direction of gravity, for example, to increase heat transfer. For example, the ribs 356 and 358 may extend horizontally outwardly from the bearing boss 350 and be spaced with a recess therebetween to impart disturbance to convection currents (e.g., upward and/or downward), to increase path length and residence time of lubricant flowing under the influence of gravity. As an example, hot air may rise upward toward the wall portion 352 where lubricant passing through the lubricant passage 320 acts to cool the air where it may travel downward, for example, generating circulation cells within the clearance space between the bearing boss 350 and the casing 400. As an example, the clearance space between the bearing boss 350 and the casing 400 may be substantially filled with lubricant, for example, depending on pressure of lubricant supplied, pressure at a lubricant outlet, etc.

As shown in the example of FIG. 3, with reference to FIG. 2, the wall portion 352 forms the lubricant passage 320 while the wall portion 354 forms the lubricant passage 340. In the example of FIG. 3, the wall portion 351 extends axially beyond ends of the wall portions 352 and 354 (e.g., away from the backplate 301 and toward the turbine side surface 308 of the bearing boss 350).

As an example, the backplate 301 of the component 300 may be disc shaped and provide one or more features for operatively coupling the backplate 301 to a compressor housing. As an example, the backplate 301 may be defined in part by an outer diameter, the turbine side surface 304 may be defined in part by an annular distance between an inner diameter and an outer diameter and the bearing boss 350 may be defined in part by an outer diameter of the outer surface 305 (e.g., corresponding to the wall portion 357 and the wall portion 352; noting that the wall portion 352 may include a stepped outer surface). As shown in the example of FIG. 3, the outer surface 305 of the bearing boss 350 includes the coupling features 375, which may be, for example, male coupling features (e.g., threads, bayonet features, etc.).

Figure 4:
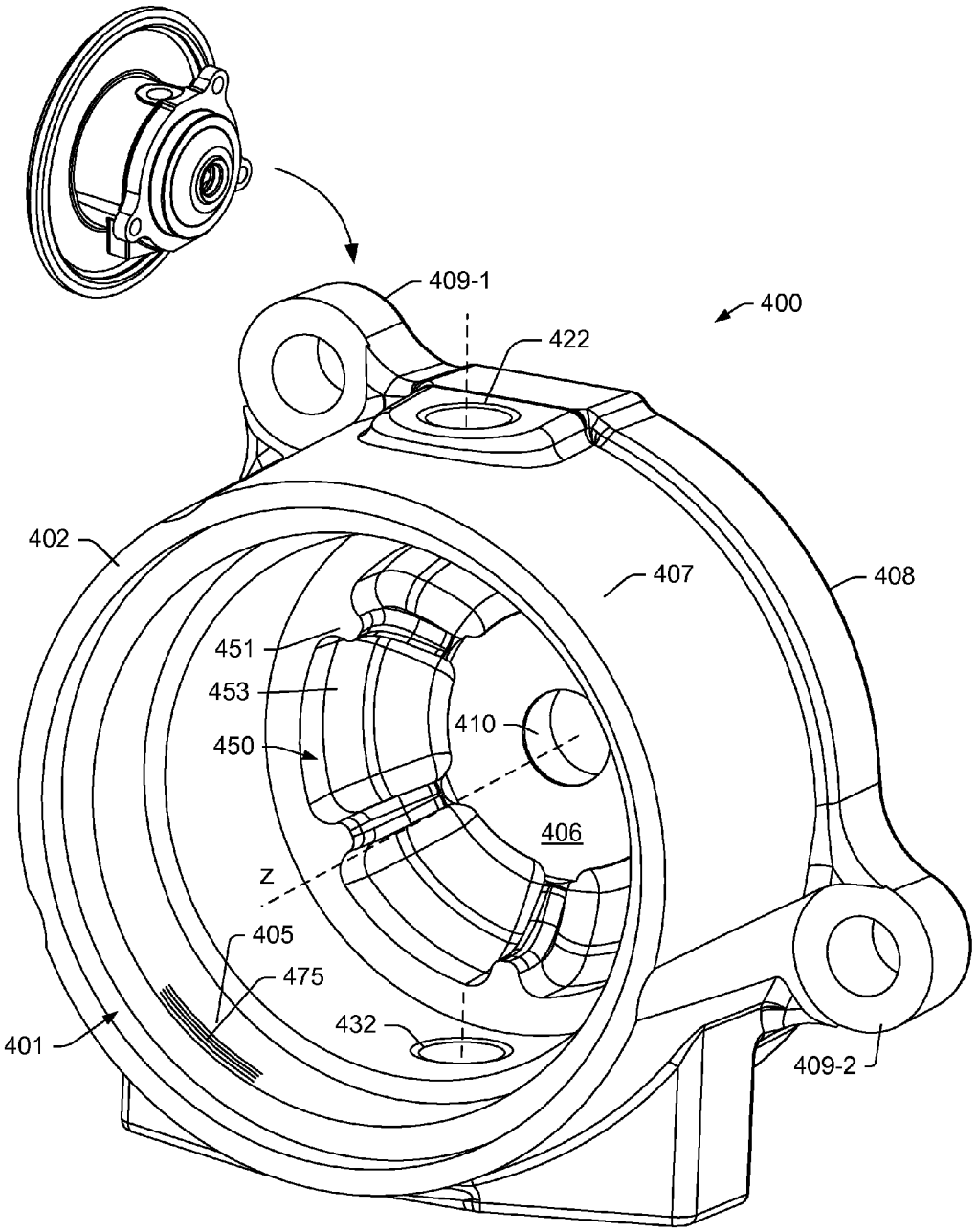
FIG. 4 is a perspective view of the center housing and a perspective view of an example of a casing of the center housing.

FIG. 4 is a perspective view of the center housing 200 of FIG. 2 and a perspective view of an example of the casing 400. In the example of FIG. 4, the casing 400 includes flange features 409-1 and 409-2, noting that the perspective view of the center housing 200 shows three such flange features (e.g., for operatively coupling a turbine housing to the casing 400). As an example, a casing may include flange features for operatively coupling the casing and a turbine assembly. As an example, a flange feature of a casing may include a bore in an extension where the extension extends radially outwardly from the casing and where the flange feature includes a surface area such as an annular surface area that faces a turbine assembly side of the flange feature. As an example, a flange feature of a casing may include a radial surface area, for example, having an approximately cylindrical shape that may act as a heat transfer surface to transfer heat energy outwardly away from the casing (e.g., radially outwardly from the flange feature surface).

In the example of FIG. 4, the casing 400 includes features 450 disposed within the cavity 401. For example, the features 450 may include ribs 451 spaced by recesses 453. As an example, such features may be defined in part via azimuthal angles about the z-axis. As an example, the casing 400 may include about three or more of the ribs 451 with three corresponding recesses 453. As an example, the casing 400 may include about six of the ribs 451 and six of the recesses 453. As an example, in an assembled state, the turbine side surface 308 of the bearing boss 350 may be positioned a distance away from the inner surface 406 of the casing 400 to avoid conduction of heat energy from the inner surface 406 to the turbine side surface 308. In such an example, lubricant that may flow from the opening 313 of the bore 310 may be slung by a rotating shaft surface and flow to the features 450. Such lubricant may then, under the influence of gravity, flow to the inlet opening 432 of the lubricant passage 430 of the casing 400. In such a manner, the lubricant may carry heat energy away from the casing 400.

As shown in the example of FIG. 4, the inner surface 405 of the casing 400 includes the coupling features 475, which may be, for example, female coupling features (e.g., threads, bayonet features, etc.). As mentioned, such features may cooperate (e.g., match) features of a bearing boss to provide for assembly of a center housing.

As an example, a center housing may include a component that includes a compressor backplate that forms a flange for connection of the center housing to a compressor housing. As an example, a center housing that includes the component and a casing coupled thereto may have a mass of about 1 kilogram (e.g., cast weight), for example, where the compressor flange of the component has a diameter of about 80 mm.

Figure 5:
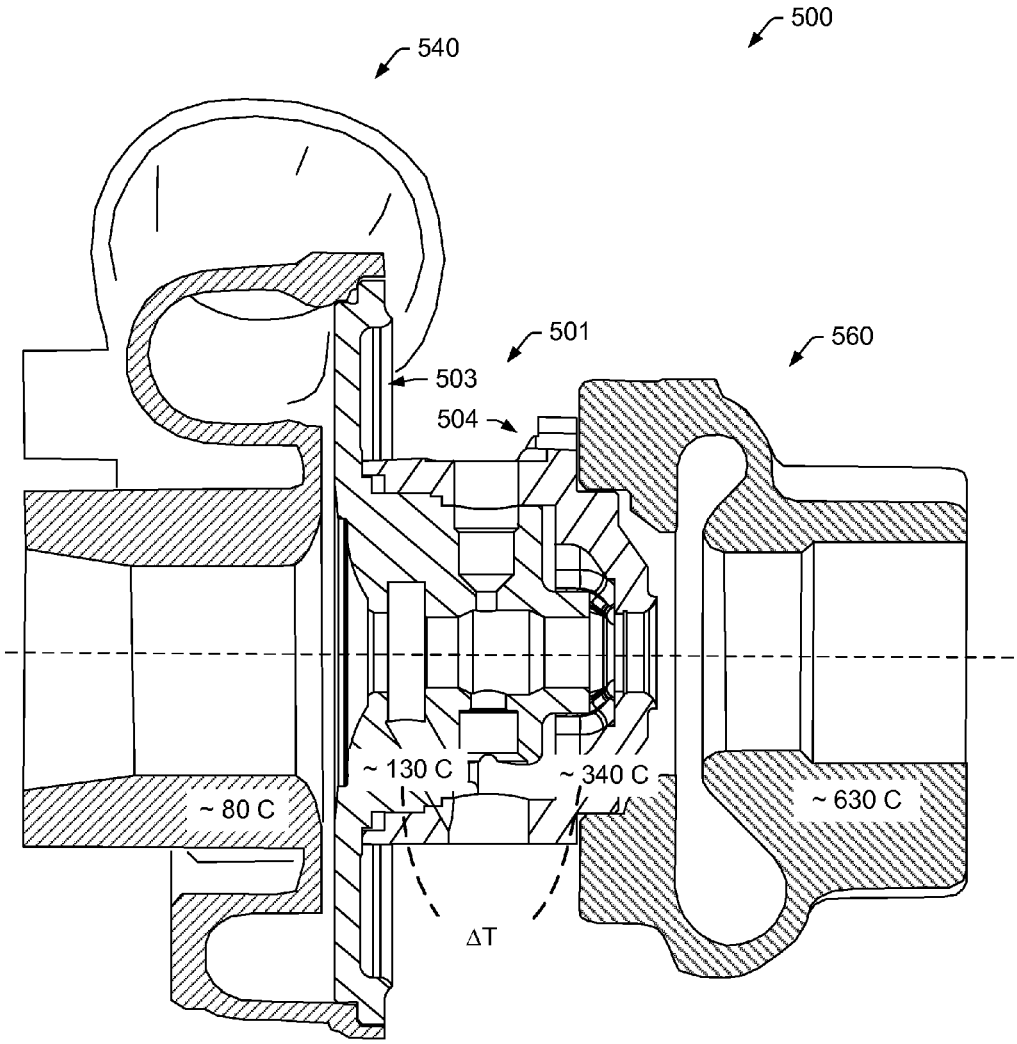
FIG. 5 is a cutaway view of an example of a turbocharger assembly along with examples of operational temperatures.

FIG. 5 is a cutaway view of an example of a turbocharger assembly 500 that includes an example of a center housing 501 disposed between an example of a compressor housing 540 and an example of a turbine housing 560. As shown, the center housing 501 includes a component 503 and a casing 504. As an example, the component 503 may be configured as the component 300 and the casing 504 may be configured as the casing 400.

In FIG. 5, various examples of operational temperatures are shown, for example, to demonstrate mitigation of soak back. The temperatures are from numerical trials for a mathematical model that includes the turbocharger assembly 500 with an exhaust temperature of about 780 degrees C. As shown, with respect to heat soak back, the turbine housing 560 may have a temperature of about 630 degrees C., the casing 504 may have a temperature of about 340 degrees C., the component 503 may have a temperature of about 130 degrees C. and the compressor housing 540 may have a temperature of about 80 degrees C. Accordingly, heat soak back temperature differentials are achieved across the center housing 501 of about 210 degrees C., in part, through use of the component 503 and the casing 504 where a clearance space exists between the component 503 and the casing 504 within the center housing 501. In such an example, the heat soak back temperature differential between the turbine housing 560 and the compressor housing 540 may be about 500 degrees C. or more. Such an approach may act to reduce soak back of heat energy, which could result in temperature increase of intake air (e.g., including charge or compressed air). Features of the center housing 501 that act to reduce soak back may improve operational efficiency, performance, longevity, etc. of a turbocharger.

In numerical trials for purposes of comparison of the center housing 501 to a single piece cast center housing, as to heat soak back, the center housing 501 achieved a reduction in bearing bore temperature of about 80 degrees C.

Figure 6:
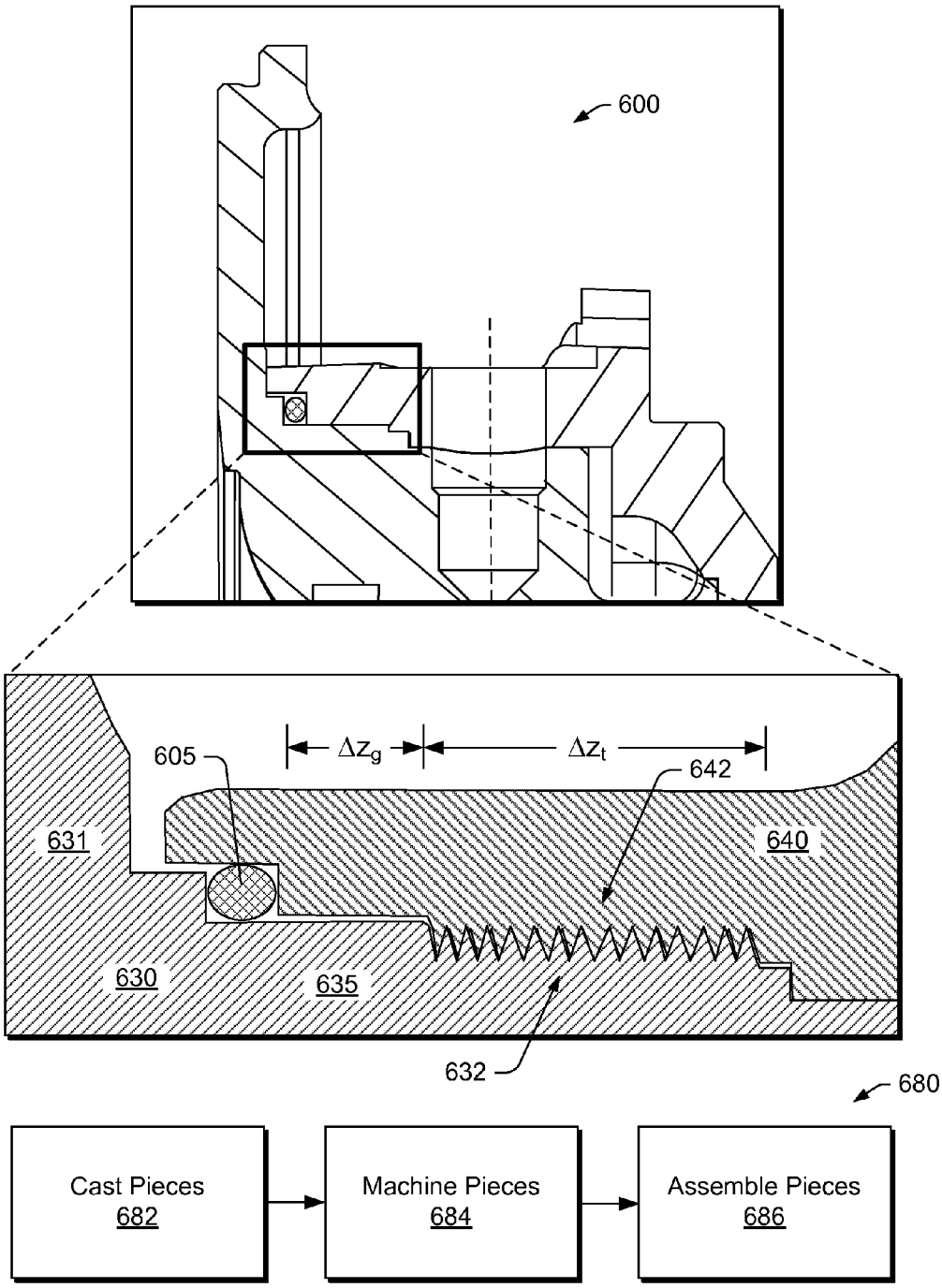
FIG. 6 is a series of views of an example of a coupling mechanism to couple components of a center housing and a block diagram of an example of a method.

FIG. 6 shows a series of views of an example of a coupling mechanism to couple components of a center housing 600. As shown in FIG. 6, a component 630 may join a casing 640 via corresponding sets of threads 632 and 642 (e.g., corresponding sets of coupling features). As an example, the threads 632 and 642 may span an axial distance $\Delta z_t$ and a guide region may span an axial distance $\Delta z_g$. As an example, such distances may be selected based in part on modes of vibration of the component 630, the casing 640 and/or the center housing 600. For example, a distance may be selected such that certain frequencies are avoided as to modes of vibration.

As an example, a seal component 605 may be disposed at least in part between the component 630 and the casing 640. In the example of FIG. 6, the component 630 may include a backplate 631 and a bearing boss 635 where the threads 632 are formed in an outer surface of the bearing boss 635. In the example of FIG. 6, the casing may define a cavity for receipt of the bearing boss 635 where the threads 642 are formed in an inner surface of the casing 640.

As an example, a clearance may exist between an axial face of the component 630 and an axial face of the casing 640, for example, where the component 605 (e.g., seal component, load component, etc.) may be disposed between the faces and axially biased therebetween. For example, the component 605 may be made of a high temperature rated material (e.g., rated to withstand at least about 150 degrees C.). Such a component may act to hinder leakage of lubricant from a center housing such as the center housing 600.

FIG. 6 also shows a method 680 that includes a cast block 682 for casting pieces, a machine block 684 for machining pieces and an assemble block 686 for assembling pieces, for example, to form a center housing. As an example, the component 630 may be cast using a casting process and the casing 640 may be cast using a casting process. In such an example, the materials used to cast the component 630 and the casing 640 may be the same or differ (e.g., same or different metal, alloy, etc.). As an example, a hardening or other treatment process may be implemented for achieving desirable properties of the component 630 and/or the casing 640. As to machining, as an example, bores may be machined, at least in part to form acceptably smooth bore surfaces. As an example, polishing may be employed as a form of machining (e.g., material removal, material resurfacing, etc.). As an example, an assembly process may include coupling a component to a casing, for example, via threads or other coupling mechanism. Such a process may include positioning one or more seal components, spacers, etc., for example, that are disposed within or between the component and the casing for a center housing in an assembled state.

As an example, a method may include machining, assembly and machining. For example, a component and a casing may be machined to form coupling features such as threads, followed by assembly to form a center housing and finish machining of the center housing. As an example, machining for features such as a bearing bore and end connections may be performed after assembly of pieces, for example, to enhance coaxiality. As an example, cross-drilling may be performed, for example, to form one or more lubricant passages, etc.

As an example, a component may include a bearing boss that extends from a backplate where threads or other coupling features are formed into an outer surface of the bearing boss. As an example, a casing may include an inner surface that includes threads or other coupling features. A center housing may be formed by providing a bearing boss that includes coupling features such as threads on an outer surface, providing a casing that includes corresponding coupling features such as threads on an inner surface and coupling the bearing boss and the casing via the coupling features.

Figure 7:
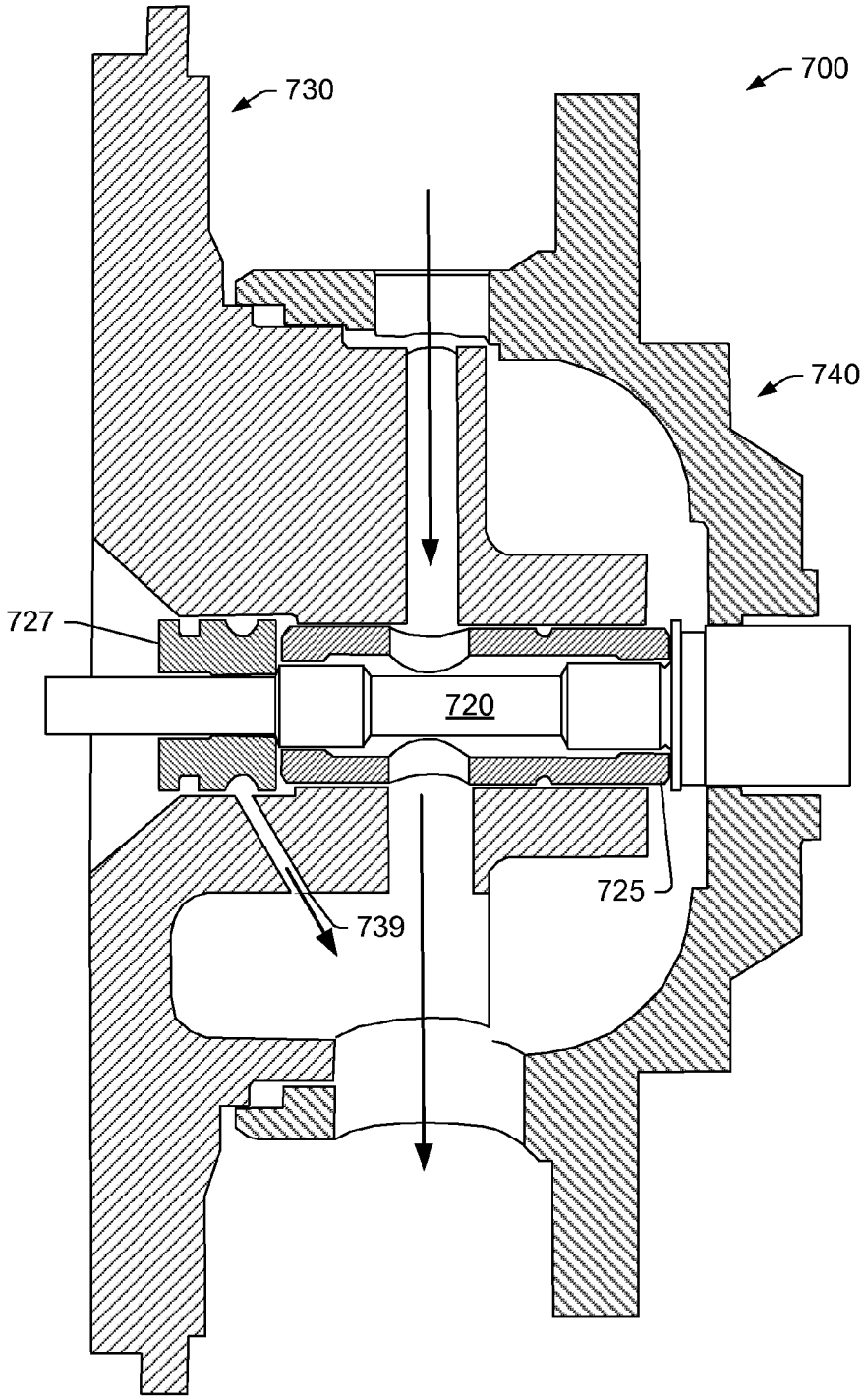
FIG. 7 is a cutaway view of an example of an assembly.

FIG. 7 shows a cutaway view of an example of an assembly 700 that includes a shaft 720, a bearing 725, a collar 727, a component 730 and a casing 740. In the example of FIG. 7, the component 730 may include a lubricant passage 739 that extends between a lubricant drainage space and a portion of a bore adjacent to the collar 727. As an example, a bearing boss may include one or more lubricant passages that extend to a portion of a bore configured to receive a collar such as a thrust collar. As an example, the collar 727 may be a thrust collar that includes slinger features, for example, to sling lubricant radially outward therefrom where a portion of the slung lubricant may flow via the lubricant passage 739.

Figure 8:
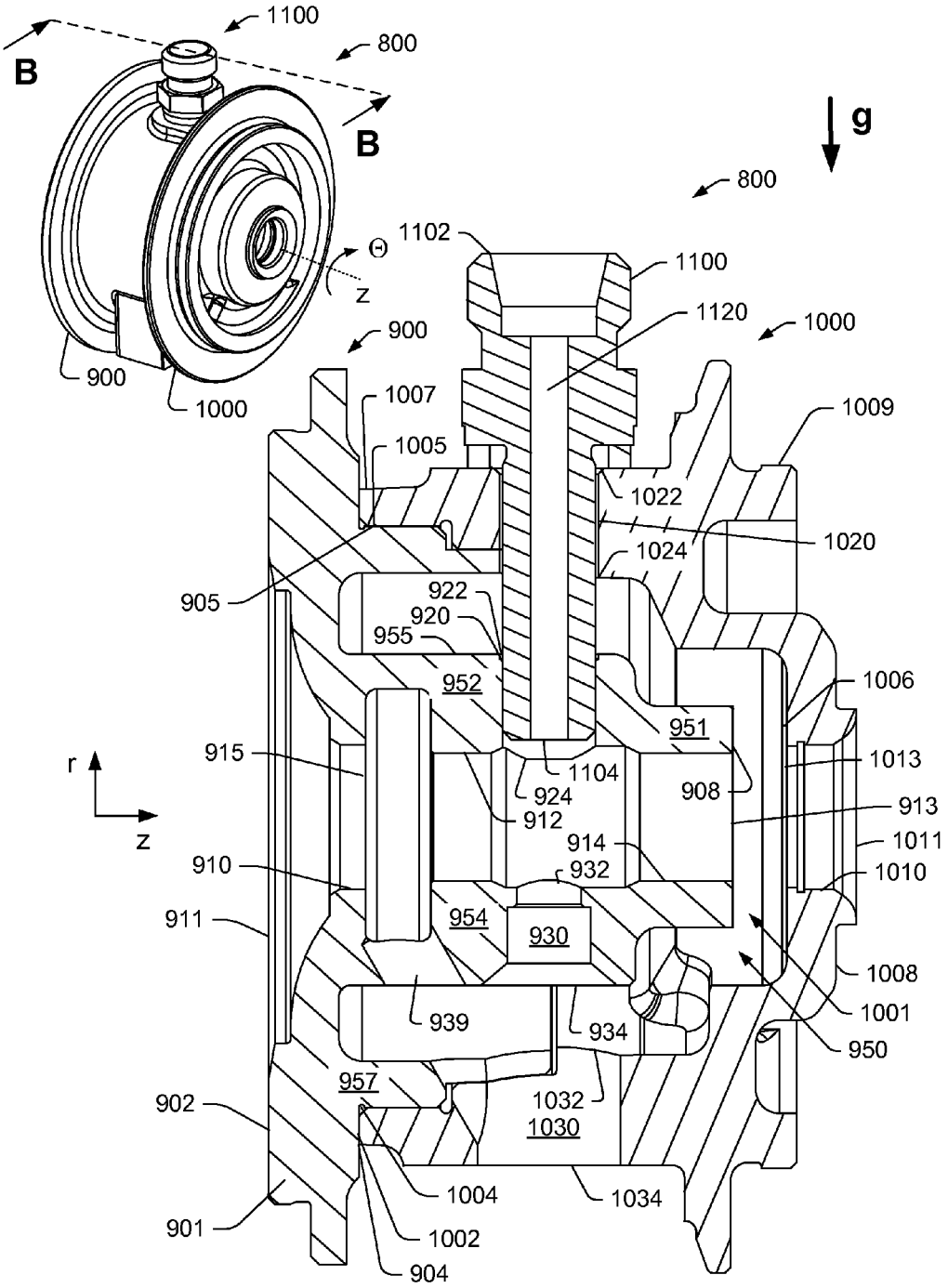
FIG. 8 is perspective view and a cross-sectional view of an example of a center housing.

FIG. 8 shows perspective view and a cross-sectional view of an example of a center housing 800 along a line B-B. As described herein, various components may be shown with respect to a cylindrical coordinate system having an axial "z" coordinate, a radial "r" coordinate and an azimuthal "Θ" coordinate (see, e.g., z-axis, r-axis and azimuthal angle Θ direction). As an example, the center housing 800 may be oriented with respect to gravity (g), for example, for purposes of lubricant flow, settling of a shaft, etc.

As shown in the example of FIG. 8, the center housing 800 includes a component 900, a casing 1000 and a pin 1100. The component 900 includes a backplate 901 and a bearing boss 950 that extends axially from the backplate 901. As an example, the component 900 may be a unitary component or multiple components coupled together (e.g., consider the backplate 901 and the bearing boss 950 as separate components operatively coupled to form the component 900). As an example, the component 900 may be a cast, unitary component that may be subsequently machined prior to its assembly as part of the center housing 800. As an example, the casing 1000 may be a unitary component or multiple components coupled together. As an example, the casing 1000 may be cast as a unitary component that may be subsequently machined prior to its assembly as part of the center housing 800.

As shown in the example of FIG. 8, the backplate 901 of the component 900 includes a compressor side surface 902 and a turbine side surface 904 from which the bearing boss 950 extends axially outwardly therefrom (e.g., in a direction of the z-axis). The backplate 901 and the bearing boss 950 form a bore 910 with a bore opening 911 where the bore 910 includes surfaces 912 and 914 that may form clearances with a bearing disposed in the bore 910 (e.g., for lubricant film formation). As shown, the bore 910 extends from the opening 911 at the compressor side surface 902 to an opening 913 at a turbine side surface 908 of the bearing boss 950. As shown, the bore 910 includes an enlarged portion 915, which may be configured for positioning of a collar where such a collar may be configured to sling lubricant.

In the example of FIG. 8, the bearing boss 950 includes wall portions 951, 952, 954 and 957. For example, the wall portion 951 forms bore surfaces 912 and 914 while the wall portion 952 forms a lubricant inlet passage 920 and the wall portion 954 forms a lubricant outlet passage 930. As shown, a radial gap exists between the wall portion 954 and the wall portion 957. In the example of FIG. 8, the bearing boss 950 includes an outer surface 905, for example, formed in part by the wall portion 952 and in part by the wall portion 957.

In the example of FIG. 8, the lubricant inlet passage 920 includes an inlet opening 922 and an outlet opening 924 that opens to the bore 910 and the lubricant outlet passage 930 includes an inlet opening 932 at the bore 910 and an outlet opening 934. Each of the passages 920 and 930 may be defined by a respective axis where, for example, they may align (e.g., a straight rod may be received by the passages 920 and 930).

As to the casing 1000, it includes a compressor end 1002 and a turbine end 1008 with a cavity 1001 formed therebetween for receipt of the bearing boss 350 via an opening 1004 at the compressor end 1002. As shown, the turbine end 1008 includes a bore 1010, for example, axially aligned with the bore 910 of the component 900, where the bore 1010 extends between an opening 1013 at an inner surface 1006 and an opening 1011 at the turbine end 1008 of the casing 1000.

In the example of FIG. 8, the casing 1000 includes a pin passage 1020 and a lubricant outlet passage 1030 where the pin passage 1020 includes an inlet opening 1022 and an outlet opening 1024 and where the lubricant outlet passage 1030 includes an inlet opening 1032 and an outlet opening 1034. The casing 1000 also includes an inner surface 1005 and an outer surface 1007 and optionally one or more flange features 1009, for example, for mounting a turbine housing to the casing 1000 (e.g., the feature 1009 may be a turbine housing flange).

In an assembled state, the center housing 800 may include one or more seal components. As an example, the component 900 and the casing 1000 may be coupled such that the compressor end 1002 of the casing 1000 abuts the turbine side surface 904 of the backplate 901. As shown in the example of FIG. 8, in an assembled state, a clearance may exists between the turbine side surface 908 of the bearing boss 950 and the inner surface 1006 of the casing 1000. As shown, in an assembled state, the surface 905 of the component 900 and the inner surface 1005 of the casing 1000 may contact, optionally via threads or another coupling mechanism.

In an assembled state, the pin passage 1020 of the casing 1000 may align with the lubricant passage 920 of the component 900, for example, where the pin 1100 may be inserted into the pin passage 1020 and at least partially into the lubricant passage 920. As shown, the pin 1100 includes a lubricant bore 1120 that extends between an inlet end 1102 and an outlet end 1104. Lubricant may be provided to the lubricant bore 1120 where such lubricant may flow to the bore 910 (e.g., to lubricate a shaft and bearing system). In the example of FIG. 8, the component 900 includes a passage 939, for example, for flow of lubricant from a portion of the bore 910 (e.g., the enlarged portion 915) to a lubricant drainage space (e.g., where lubricant may drain via the lubricant passage 1030 of the casing 1000). In the example of FIG. 8, lubricant may exit the bore 910 at the turbine side surface 908 (e.g., via the opening 913) and flow to the lubricant drainage space (e.g., where lubricant may drain via the lubricant passage 1030 of the casing 1000).

As an example, in an installed state (e.g., in an engine compartment), the passages 920, 930, 1020, 1030 and 1120 may be approximately aligned with gravity (g). In such a manner, lubricant may drain from the center housing 800 due to gravity.

As shown in the example of FIG. 8, in an assembled state, various clearances exist within the center housing 800 between the component 900 and the casing 1000. In particular, clearances exist about the bearing boss 950 and the casing 1000 that may act to reduce heat transfer from the turbine end 1008 of the casing 1000 to the bearing boss 950 of the component 900 (e.g., reduce heat soak back).

In the example of FIG. 8, the pin 1100 may be a coupling mechanism that acts to couple the component 900 and the casing 1000 via coupling features where the coupling features are the pin passage 1020 of the casing 1000 and the lubricant passage 920 of the component 900. In such an example, the coupling features include the opening 1024 along an inner surface 1005 of the casing 1000 and the opening 922 along an outer surface 955 of the component 900. As an example, the casing 1000 may include coupling features along a portion of the inner surface 1005 and the component 900 may include coupling features along a portion of the outer surface 905. In such an example, the casing 1000 may include female coupling features while the component 900 includes male coupling features. In such an example, the coupling features in the assembled state are within the casing 1000 (e.g., within the cavity 1001 defined by the casing 1000). As an example, the pin 1100 may be a locking pin, which may be permanent or removable, for example, to facilitate disassembly of the center housing 800.

Figure 9:
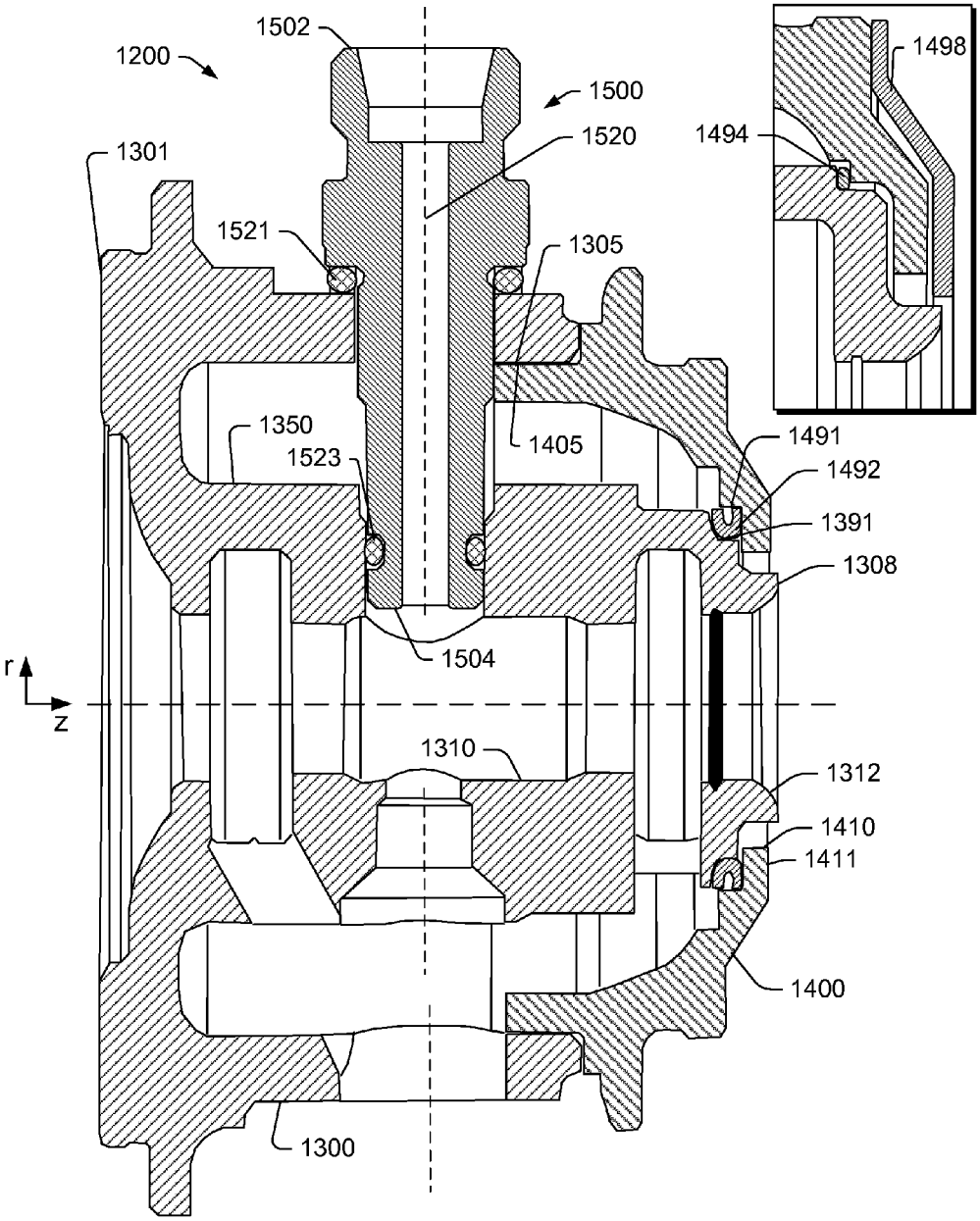
FIG. 9 is a cutaway view of an example of a center housing.

FIG. 9 is shows a cutaway view of an example of a center housing 1200. As described herein, various components may be shown with respect to a cylindrical coordinate system having an axial "z" coordinate, a radial "r" coordinate and an azimuthal "Θ" coordinate (see, e.g., z-axis, r-axis and azimuthal angle Θ direction). As an example, the center housing 1200 may be oriented with respect to gravity (g), for example, for purposes of lubricant flow, settling of a shaft, etc.

As shown in the example of FIG. 9, the center housing 1200 includes a component 1300, a casing 1400 and a pin 1500. The component 1300 includes a backplate 1301 and a bearing boss 1350 that extends axially from the backplate 1301. As an example, the component 1300 may be a unitary component or multiple components coupled together (e.g., consider the backplate 1301 and the bearing boss 1350 as separate components operatively coupled to form the component 1300). As an example, the component 1300 may be a cast, unitary component that may be subsequently machined prior to its assembly as part of the center housing 1200. As an example, the casing 1400 may be a unitary component or multiple components coupled together. As an example, the casing 1400 may be cast as a unitary component that may be subsequently machined prior to its assembly as part of the center housing 1200.

In the example of FIG. 9, a seal element 1492 is disposed between the component 1300 and the casing 1400. As shown, the seal element 1492 may include a U-shaped cross-section and may be compressible, for example, such that the U-shape may be compressed by application of force (e.g., a clamping force that couples the component 1300 and the casing 1400). As an example, a seal element such as a piston ring, O-ring, etc. may be used. For example, in an inset cutaway view, a seal element 1494 is illustrated along with a heat shield 1498 that may be disposed at a turbine end of the center housing 1200.

In the example of FIG. 9, the component 1300 includes a turbine end 1308 with a bore opening 1312 of a through bore 1310 where the turbine end 1308 extends axially through an opening 1410 of the casing 1400, for example, optionally past a turbine end 1411 of the casing 1400. As shown, the heat shield 1498 may shield the center housing 1200 and, for example, a gap may exist between the heat shield 1498 and the casing 1400 and another gap may exist between the casing 1400 and the component 1300. In such an example, heat transfer may be diminished by presence of such gaps. As an example, direct contact may be avoided between the component 1300 and the casing 1400 at a turbine end of the center housing 1200, for example, via the seal element 1492 and/or the seal element 1494.

As shown in FIG. 9, a seal element may be seated axially between the component 1300 and the casing 1400. For example, a seal element may be seated in a seal chamber formed by an annular shoulder 1391 of the component 1300 and an annular shoulder 1491 of the casing 1400. For example, each of the shoulders 1391 and 1491 may include an annular face where a seal element may be axially compressed between such annular faces. As an example, a seal element may seal a fluid chamber from leakage of fluid or protect a chamber from intrusion of fluid (e.g., liquid and/or gas). For example, the seal element 1492 and/or the seal element 1494 may seal a chamber from intrusion of exhaust and seal the chamber from leakage of lubricant (e.g., oil).

In the example of FIG. 9, the component 1300 may join the casing 1400 at a joint, for example, between an inner surface 1305 of the component 1300 and an outer surface 1405 of the casing 1400. As an example, the surfaces 1305 and 1405 may include matching threads, bayonet features, etc. As an example, a seal element may be provided, for example, as in the example of FIG. 6 (see, e.g., the seal element 605) where portions of the component 1300 and the casing 1400 can exert force against the seal element (e.g., upon threading, welding, etc.).

In the example of FIG. 9, the pin 1500 includes a lubricant bore 1520 that extends between an inlet end 1502 and an outlet end 1504. Lubricant may be provided to the lubricant bore 1520 where such lubricant may flow to the bore 1310 (e.g., to lubricate a shaft and bearing system). In the example of FIG. 9, the pin 1500 is fitted with an O-ring 1521 and an O-ring 1523.

Figure 10:
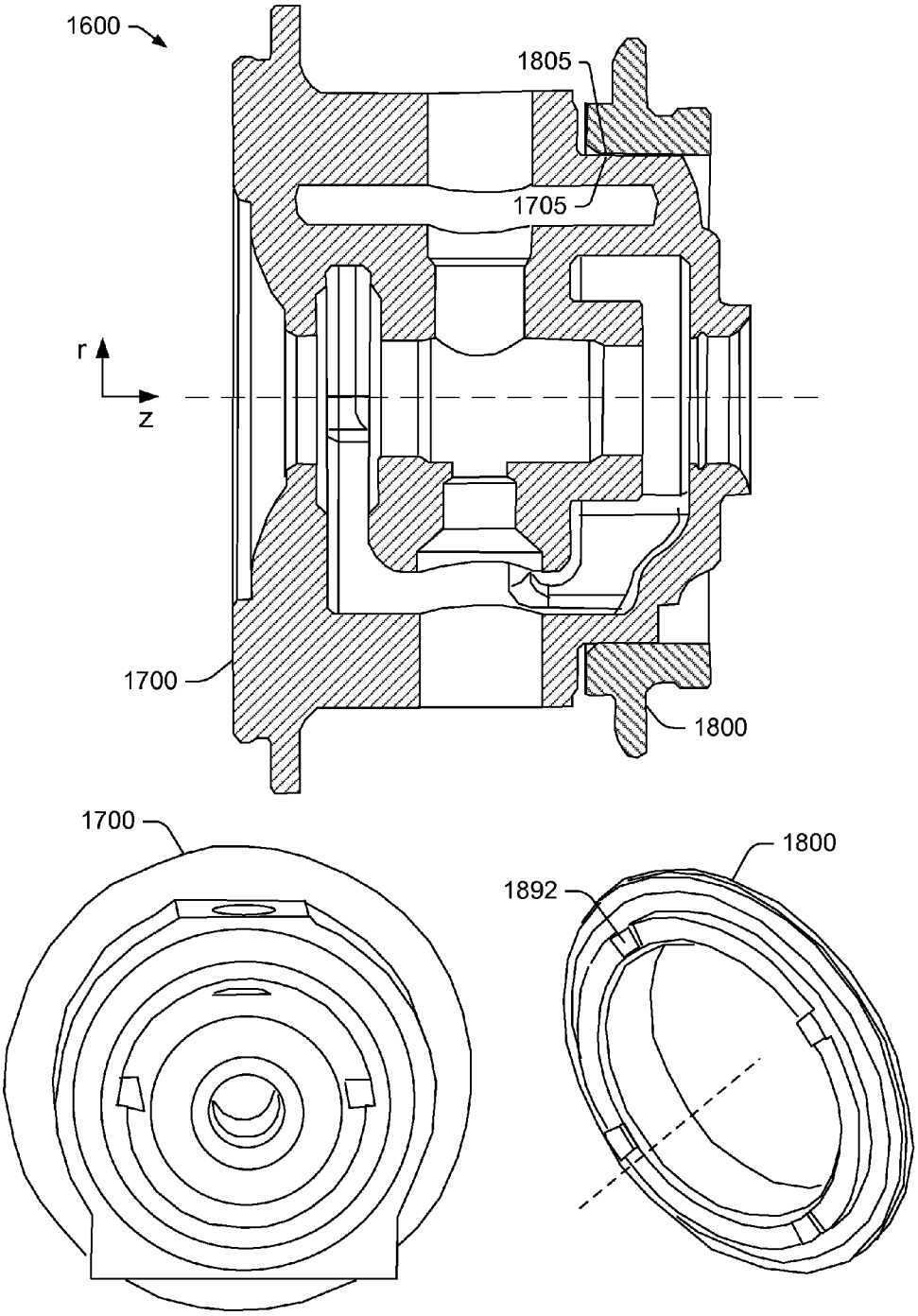
FIG. 10 is a cutaway view of an example of a center housing and perspective views of components of the center housing.

FIG. 10 shows a cutaway view of an example of a center housing 1600 and perspective views of components 1700 and 1800 of the center housing 1600. As described herein, various components may be shown with respect to a cylindrical coordinate system having an axial "z" coordinate, a radial "r" coordinate and an azimuthal "Θ" coordinate (see, e.g., z-axis, r-axis and azimuthal angle Θ direction). As an example, the center housing 1600 may be oriented with respect to gravity (g), for example, for purposes of lubricant flow, settling of a shaft, etc.

In the example of FIG. 10, the component 1700 may join the component 1800 at a joint, for example, between an outer surface 1705 of the component 1700 and an inner surface 1805 of the component 1800. As an example, the surfaces 1705 and 1805 may include matching threads, bayonet features, etc. As an example, a seal element may be provided, for example, as in the example of FIG. 6 (see, e.g., the seal element 605) where portions of the component 1700 and the component 1800 can exert force against the seal element (e.g., upon threading, welding, etc.).

As an example, the component 1800 may include pads 1892 that may act to space the component 1800 axially with respect to an annular surface of the component 1700. As an example, such pads may act to reduce contact surface area between the component 1800 and the component 1700.

Figure 11:
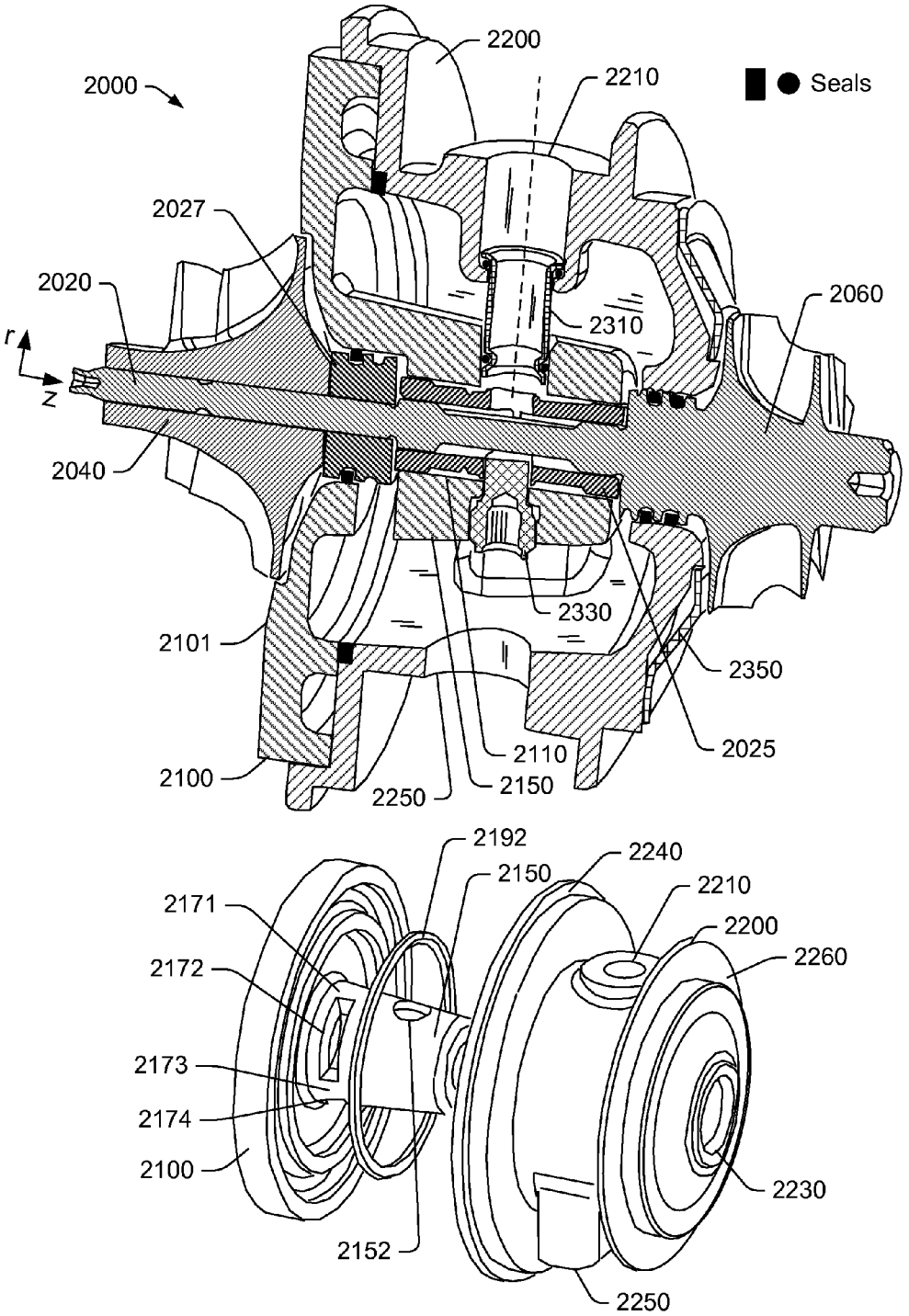
FIG. 11 is a cutaway view of an example of a center housing and an exploded view of several components of the center housing.

FIG. 11 shows a cutaway view of an example of a center housing 2000 and an exploded view of a component 2100, a seal element 2192 and a casing 2220 of the center housing 2000. As described herein, various components may be shown with respect to a cylindrical coordinate system having an axial "z" coordinate, a radial "r" coordinate and an azimuthal "Θ" coordinate (see, e.g., z-axis, r-axis and azimuthal angle Θ direction). As an example, the center housing 2000 may be oriented with respect to gravity (g), for example, for purposes of lubricant flow, settling of a shaft, etc. In the example of FIG. 11, the center housing 2000 is shown as a center housing rotating assembly (CHRA) that includes a shaft 2020, a bearing 2025 that supports the shaft 2020, a collar 2027, a compressor wheel 2040 fit to the shaft 2020 and a turbine wheel 2060 fit the shaft 2020 as part of a shaft and wheel assembly (SWA).

As shown in the example of FIG. 11, the center housing 2000 includes the component 2100, the casing 2200 and a seal element 2192 disposed between the component 2100 and the casing 2200. The component 2100 includes a backplate 2101 and a bearing boss 2150 that extends axially from the backplate 2101 and that includes a through bore 2110 configured for receipt of a bearing (see, e.g., the bearing 2025). As an example, the component 2100 may be a unitary component or multiple components coupled together (e.g., consider the backplate 2101 and the bearing boss 2150 as separate components operatively coupled to form the component 2100). As an example, the component 2100 may be a cast, unitary component that may be subsequently machined prior to its assembly as part of the center housing 2000.

In the example of FIG. 11, the casing 2200 includes a lubricant inlet 2210, a bore opening 2230, a compressor side flange 2240, a lubricant outlet 2250, and a turbine side flange 2260. As an example, the casing 2200 may be a unitary component or multiple components coupled together. As an example, the casing 2200 may be cast as a unitary component that may be subsequently machined prior to its assembly as part of the center housing 2000.

As an example, the center housing 2000 can include an oil-feed transfer tube 2310, for example, sealed with O-rings. As an example, the tube 2310 may be configured to be press-fit and, for example, held in position by a hydraulic fitting or screw in features. As shown, the bearing boss 2150 can include an opening 2152 for receipt of a locating pin 2330 that can extend into the bore 2110 defined by the bearing boss 2150 to locate a bearing with respect to the bearing boss 2150. As an example, the component 2100 may be referred to as a bearing carrier as a bearing (see, e.g., the bearing 2025) may be carried by the bearing boss 2150, optionally positioned in the bore 2110 of the bearing boss 2150 prior to assembly of the component 2100 to the casing 2200. Once assembled, as shown, spaces exist between the bearing boss 2150 and the casing 2200 that can act to thermally decouple the bearing boss 2150 from the casing 2200.

As shown in the example of FIG. 11, the bearing boss 2150 is bridged to the backplate 2101 by extensions 2171 and 2173 that are separated by gaps 2172 and 2174 (e.g., noting that one or more additional extensions and one or more additional gaps may be included). In such a configuration, the bearing boss 2150 is further thermally decoupled. As an example, a gap may span an arc angle and an extension may span an arc angle (e.g., about an axis of the through bore 2110 of the bearing boss 2150). As an example, a gap may be defined by an axial length and an extension may be defined by an axial length. In the example of FIG. 11, the bearing boss 2150 may be additionally supported, in part, for example, by the tube 2310 (e.g., depending on the material, thickness, coupling mechanism, etc. implemented).

As an example, the bearing boss 2150 of the component 2100 may be referred to as a cantilevered extension of the backplate 2101 (e.g., a compressor stage backplate) of the component 2100. As an example, the center housing 2000 may help to reduce heat transfer from a turbine stage during operation and, for example, during hot shutdown phases when the turbine stage thermal mass may cause heating of a center housing and bearing components, which, in turn, may lead to build-up of oil coke (e.g., on one or more bearing components). As an example, the center housing 2000 may help to reduce rotordynamic vibration transfer, improve center housing drainage, simplify center housing casting and machining etc.

In various trials, a turbocharger with a center housing such as the center housing 2000 of FIG. 11 was instrumented with thermocouples at a series of locations. Various trials examined bearing location time-temperature integrals, which demonstrated that, across a 600 second cycle of a heat soak back event, the thermal energy at the bearing locations for the turbocharger was lower than that for a baseline turbocharger (e.g., consider a GTC2260VZ model turbocharger). Such trials indicate that the turbocharger, when compared to the baseline turbocharger, may reduce oil coking because formation of coke tends to be a function of, amongst other factors, surface temperature and residence time at elevated temperature.

Various trials demonstrated that a reduction in bearing boss temperatures could be as much as about 55 degrees C. and could reduce sensitivity of bearing peak temperatures to a steady state value. Particular trials subjected turbochargers to nominally equal hot shutdown conditions from a steady state of about 830 degrees C., about 860 degrees C. and about 900 degrees C. Using a center housing such as that of FIG. 11, the trials demonstrated that peak heat soak back temperatures in the bearing region could be reduced at the turbine end of the bearing and at the compressor wheel end.

As shown in the example of FIG. 11, the center housing 2000 may be fitted with a heat shield 2350, for example, to help reduce heat transfer from exhaust to the center housing 2000.

Figure 12:
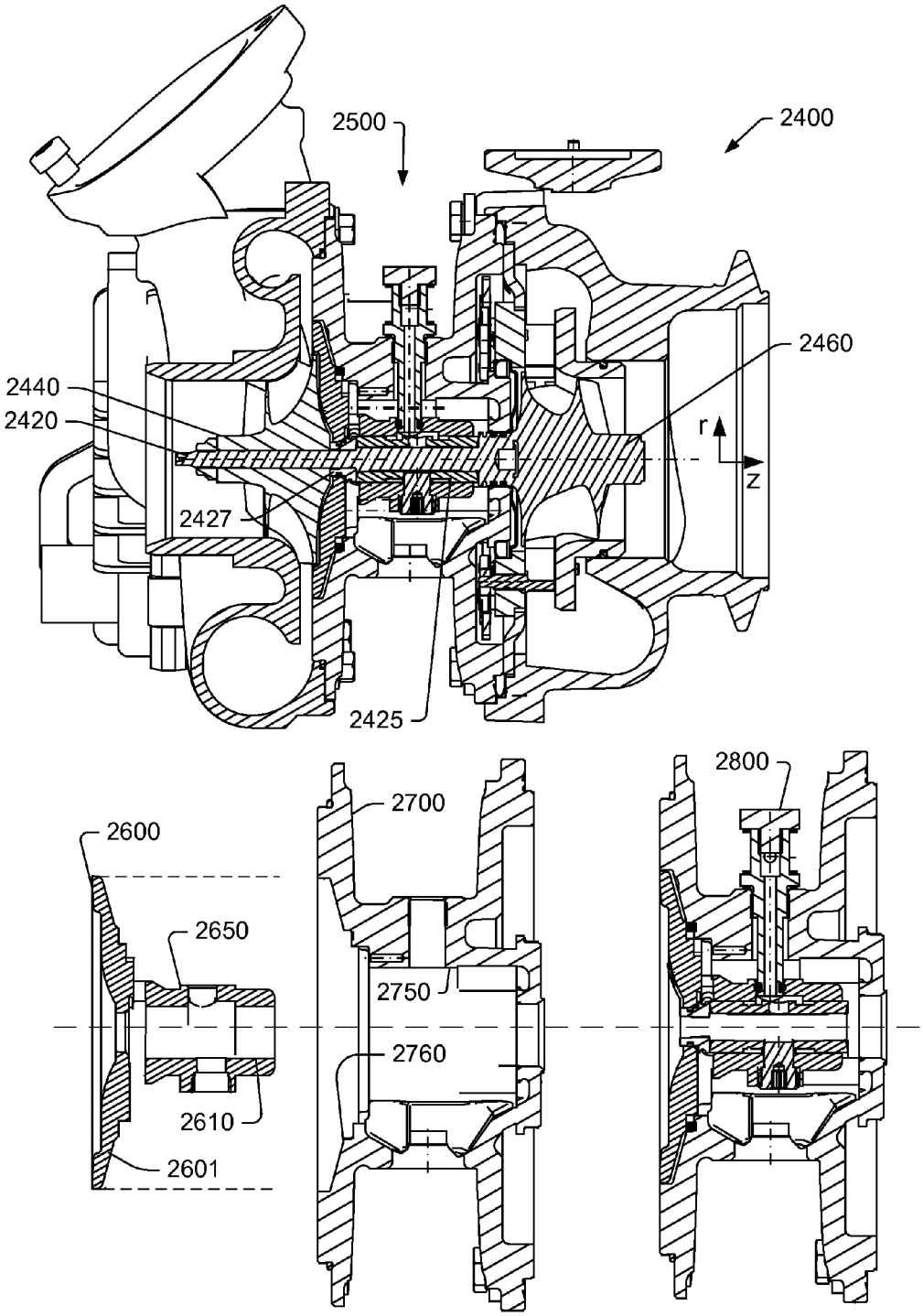
FIG. 12 is a series of cutaway views of an example of a center housing.

FIG. 12 shows a cutaway view of an example of a turbocharger 2400 that includes a center housing 2500 along with several additional cutaway views of a component 2600, a casing 2700 and a pin 2800 of the center housing 2500. In the example of FIG. 12, the turbocharger 2400 includes a shaft 2420, a bearing 2425, a collar 2427, a compressor wheel 2440 and a turbine wheel 2460.

In the example of FIG. 12, the component 2600 includes a backplate 2601 and a bore 2610 defined by a bearing boss 2650 that extends axially from the backplate 2601. The bearing boss 2650 may be joined at one or more points to the backplate 2601 (see, e.g., the component 2100 of FIG. 11). As shown the casing 2700 includes a wall 2750 the defines in part a cavity configured for receipt of the bearing boss 2650 of the component 2600, for example, where the backplate 2601 of the component 2600 is seated in a recess 2760 of the casing 2700.

As described herein, various components may be shown with respect to a cylindrical coordinate system having an axial "z" coordinate, a radial "r" coordinate and an azimuthal "Θ" coordinate (see, e.g., z-axis, r-axis and azimuthal angle Θ direction). As an example, the center housing 2500 may be oriented with respect to gravity (g), for example, for purposes of lubricant flow, settling of a shaft, etc.

Figure 13:
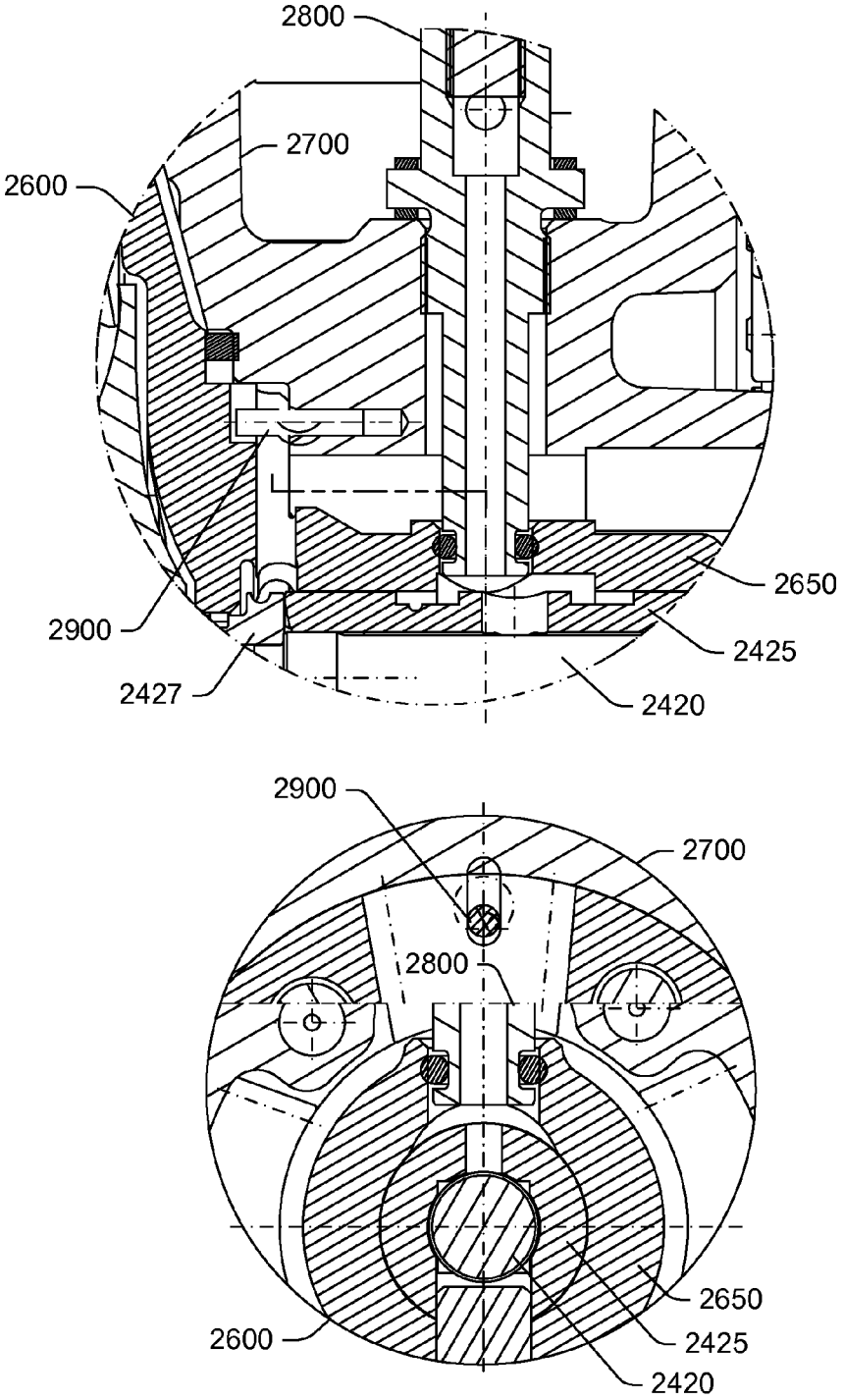
FIG. 13 is a series of cross-sectional views of portions of the center housing of FIG. 12.

FIG. 13 shows additional cutaway views of the center housing 2500 of FIG. 12. As shown, the center housing 2500 may include a locating mechanism 2900 for locating the component 2600 with respect to the casing 2700.

Figure 14:
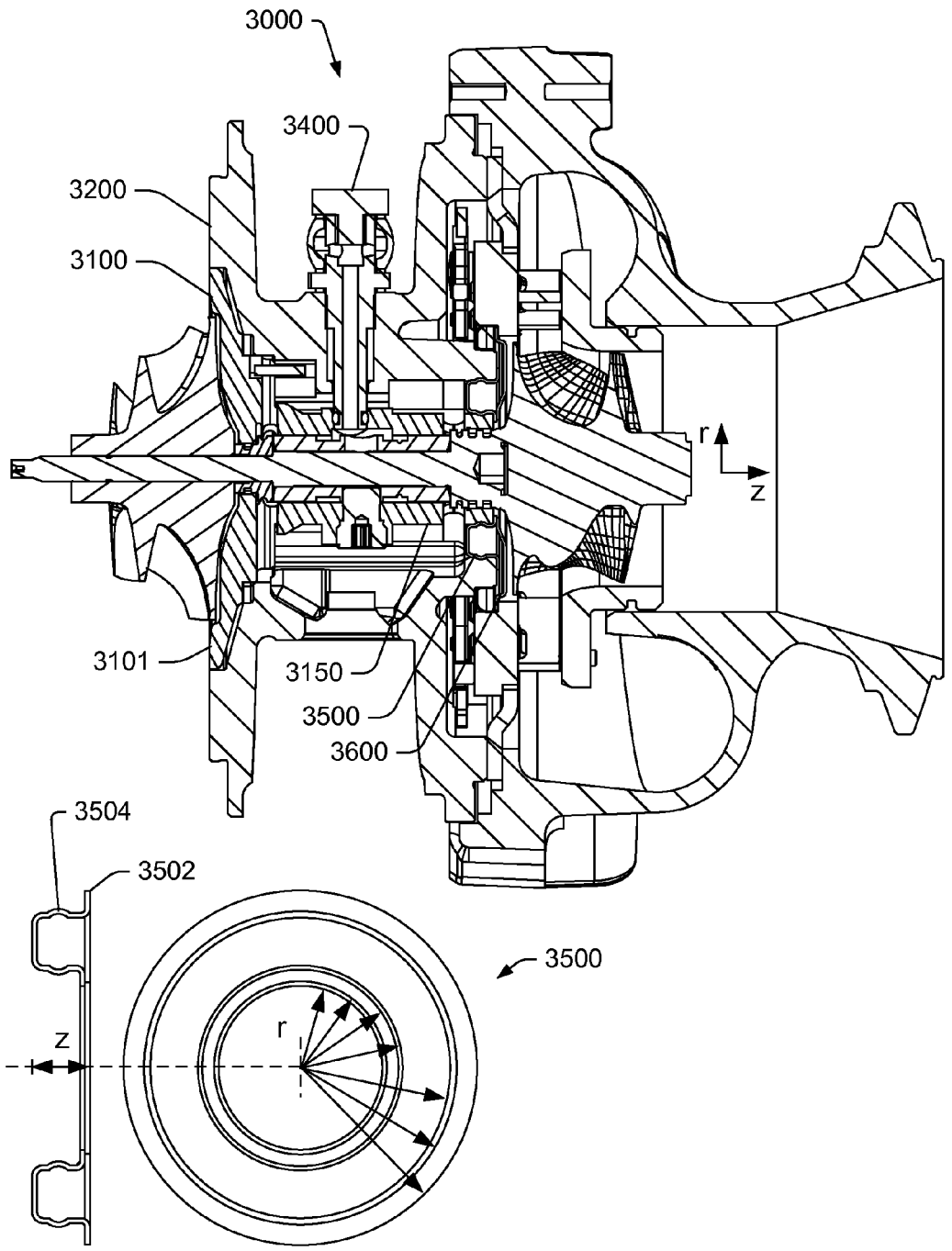
FIG. 14 is a cutaway view of an example of a center housing.

FIG. 14 shows an example of a center housing 3000 that includes a component 3100, a casing 3200, a pin 3400 and a plate 3500. As described herein, various components may be shown with respect to a cylindrical coordinate system having an axial "z" coordinate, a radial "r" coordinate and an azimuthal "Θ" coordinate (see, e.g., z-axis, r-axis and azimuthal angle Θ direction). As an example, the center housing 3000 may be oriented with respect to gravity (g), for example, for purposes of lubricant flow, settling of a shaft, etc.

In the example of FIG. 14, the component 3100 includes a backplate 3101 and a bearing boss 3150 that extends axially away from the backplate 3101. As shown, the bearing boss 3150 extends to a turbine wheel where the plate 3500 includes a rim 3502 and an annular extension 3504 that can, for example, be press-fit onto the bearing boss 3150 and to secure the bearing boss 3150 with respect to the casing 3200. For example, the casing 3200 and the bearing boss 3150 may form an annular opening at a turbine end of the center housing 3000 where the plate 3500 may be press-fit into the annular opening. As shown in the example of FIG. 14, the plate 3500 may be made with a thickness that acts to reduce heat transfer (e.g., reduced thermal mass). Further, the plate 3500 may be shaped to create a gap between the bearing boss 3150 and the casing 3200. In FIG. 14, the plate 3500 is shown with respect to various dimensions with respect to a z-axis including radii about the z-axis. While the plate 3500 is shown as being relatively symmetric, such a plate may include features, for example, consider a locating feature (e.g., a key or keyway) that orients the plate with respect to a bearing boss, etc. (e.g., with a corresponding keyway or key).

As shown in FIG. 14, a heat shield 3600 may be positioned over the plate 3500, for example, to shield the plate 3500 from exhaust. In the example of FIG. 14, the casing 3200 is configured to receive components of a variable geometry mechanism. For example, the casing 3200 is shown as including an annular recess that receives components such as a unison ring and related components to control vanes that define throats for flow of exhaust to a turbine wheel.

In the various examples, features described with respect to one or more center housings may appear in other or more other center housing. For example, the example of FIG. 7 includes a shaft 720 supported by a bearing 725. Other examples may likewise include a shaft supported by a bearing, for example, where a center housing is part of a center housing rotating assembly (CHRA), a turbocharger, etc.

As an example, a component and a casing may be coupled using a process such as welding. For example, a component such as the component 300 of FIG. 3 and a casing such as the casing 400 of FIG. 4 may be welded about at a joint. For example, consider welding at a joint formed by the turbine side surface 304 of the component 300 and compressor end 402 of the casing 400. As an example, a magnetic pulse welding technique may be employed to join a component and a casing to form a center housing. As an example, a laser welding technique may be employed to join a component and a casing to form a center housing.

As an example, a casting process to form a component and/or a casing may employ a green sand molding technique. Green sand is a term for molding sand that may be bonded together with clay and moisture. As an example, sand may be compacted about a dummy shape using a two piece mold box. In such an example, the dummy shape may be removed. Where a void or voids are to be formed, a core or cores may be positioned with respect to the compacted sand in the two piece mold box. The mold box may then be closed and filled with material that can flow to spaces between the compacted sand and a core or cores, if present. After solidification of the material, the cast component may be removed from the mold, optionally followed by decoring. Post-cast machining and cleaning may follow, optionally including one or more treatments (e.g., heat treatment, chemical treatment, etc.). As an example, machining may include machining a cast component and a cast casing, for example, as to one or more bores, bore wall surfaces, connection surfaces, lubricant passages, lubricant passage surfaces, etc.

As an example, a center housing formed from a component such as the component 300 of FIG. 3 and from a casing such as the casing 400 of FIG. 4 may include fewer casting cavities than that of a unitary center housing. For example, a casting process to for a unitary center housing may include about 12 casting cavities while a multi-piece center housing such as the center housing 200 of FIG. 2 may include about 8 casting cavities. A reduction in number of casting cavities may help reduce traps for debris, inaccessible regions as to machining, inspection, etc. As an example, a multi-piece center housing such as the center housing 200 of FIG. 2 may be formed using a coreless casting process (e.g., without a multi-piece core as used in casting a unitary center housing).

An assembly can include a compressor backplate; a bearing boss that extends axially from the compressor backplate and that includes an outer surface and male coupling features disposed along the outer surface; and a casing that includes a compressor end, a bearing boss opening at the compressor end, a turbine end, an inner surface located between the compressor end and the turbine end and female coupling features disposed along a portion of the inner surface, the male coupling features and the female coupling features configured to couple the bearing boss to the casing. In such an example, the compressor backplate and the bearing boss may be integral (e.g., a unitary piece).

As an example, a compressor backplate and a bearing boss may be a cast component and a casing may be a cast casing. As an example, coupling features may be machined into a cast component and into a cast casing. As an example, male coupling features and female coupling features may be or include threads.

As an example, a bearing boss may include (e.g., define) a bore and a casing may include (e.g., define) a bore that is coaxially aligned with the bore of the bearing boss. In such an example, a clearance may exist (e.g., an axial gap) between a turbine side surface of the bearing boss and an inner surface of the casing (e.g., as disposed about the bore of the casing).

As an example, a bearing boss may include a lubricant passage and a casing may include a pin passage. As an example, an assembly may include a pin configured for receipt by the pin passage and at least partially by the lubricant passage.

As an example, a casing may include one or more flange features for operatively coupling the casing to a turbine housing. As an example, a backplate may include one or more features for operatively coupling the backplate (e.g., an a bearing boss integral thereto) to a compressor housing.

As an example, a bearing boss may define a bore that includes a portion configured for receipt of a journal bearing and a portion configured for receipt of a collar. As an example, an assembly may include the journal bearing and the collar. As an example, such a journal bearing may be a unitary bearing with outer surfaces disposed at a diameter where such outer surfaces define clearances with respect to inner journal surfaces of a bore of a bearing boss. In such an example, lubricant may flow to the clearances to define lubricant films. As an example, a bearing may optionally be located, for example, axially and azimuthally in a bore of a bearing boss. In such an example, the bearing may move radially, for example, to allow for functioning of one or more lubricant films (e.g., squeeze films, etc.).

As an example, an assembly may include a shaft coupled to a turbine wheel (e.g., a shaft and wheel assembly ("SWA")) where a journal bearing is received by a bore of the bearing boss and where the shaft is supported by the journal bearing.

As an example, a bearing boss may include a lubricant passage that extends from a portion of the bore configured for receipt of a journal bearing and, for example, a lubricant passage that extends from a portion of the bore configured for receipt of a collar.

As an example, an assembly may include a locating pin for locating a bearing in a bore defined by a bearing boss. As an example, such a pin may include a passage for flow of lubricant. As an example, such a pin may be inserted via an upper side or a lower side of a center housing (e.g., as aligned with gravity).

As an example, a method can include casting a backplate and a bearing boss as a first unitary component; casting a casing as a second unitary component; machining male coupling features into the first unitary component; machining female coupling features into the second unitary component; and coupling the first unitary component to the second unitary component via the male coupling features and the female coupling features.

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions.

What is claimed is:

1. An assembly comprising:

a compressor backplate;

a cylindrical wall, integral to the compressor backplate, that extends axially from the compressor backplate and that comprises an outer surface that comprises male coupling features;

a bearing boss, integral to the compressor backplate, that extends axially from the cylindrical wall and that comprises ribs that extend radially outwardly from the bearing boss to increase heat transfer surface area; and a casing that comprises a compressor end, a turbine end, an inner surface located between the compressor end and the turbine end and female coupling features disposed along a portion of the inner surface, the male coupling features and the female coupling features configured to couple the cylindrical wall to the casing to define a cavity wherein the ribs of the bearing boss increase path length of lubricant flow in the cavity and wherein the male coupling features and the female coupling features comprise threads;

wherein the bearing boss comprises a bore, wherein the casing comprises a bore coaxially aligned with the bore of the bearing boss and wherein a clearance exists between a turbine side surface of the bearing boss and an inner surface of the casing disposed about the bore of the casing to hinder transfer of heat energy to the bearing boss.

2. The assembly of claim 1 wherein the compressor backplate, the cylindrical wall and the bearing boss are a cast component.

3. The assembly of claim 2 wherein the casing is a cast casing.

4. The assembly of claim 2 wherein the male coupling features are machined into the cast component.

5. The assembly of claim 3 wherein the female coupling features are machined into the cast casing.

6. The assembly of claim 1 wherein the bearing boss comprises a lubricant passage and wherein the casing comprises a pin passage and further comprising a pin configured for receipt by the pin passage and at least partially by the lubricant passage.

7. The assembly of claim 1 wherein the casing comprises one or more flange features for operatively coupling the casing to a turbine housing.

8. The assembly of claim 1 wherein the bore of the bearing boss comprises a portion configured for receipt of a journal bearing and a portion configured for receipt of a collar.

9. The assembly of claim 8 further comprising the journal bearing and the collar.

10. The assembly of claim 9 further comprising a shaft coupled to a turbine wheel wherein the journal bearing is received by the bore of the bearing boss and wherein the shaft is supported by the journal bearing.

11. The assembly of claim 8 wherein the bearing boss comprises a lubricant passage that extends from the portion of the bore of the bearing boss configured for receipt of a journal bearing.

12. The assembly of claim 8 wherein the bearing boss comprises a lubricant passage that extends from the portion of the bore of the bearing boss configured for receipt of a collar.

13. The assembly of claim 1 further comprising a locating pin for locating a bearing in the bore of the bearing boss.

14. A method comprising:

casting a backplate, a cylindrical wall and a bearing boss as a first unitary component wherein the bearing boss comprises ribs that extend radially outwardly from the bearing boss to increase heat transfer surface area;

casting a casing as a second unitary component;

machining male threads into the first unitary component;

machining female threads into the second unitary component; and coupling the first unitary component to the second unitary component via the male threads and the female threads to define a cavity wherein the ribs of the bearing boss increase path length of lubricant flow in the cavity, wherein the bearing boss comprises a bore, wherein the casing comprises a bore coaxially aligned with the bore of the bearing boss and wherein a clearance exists between a turbine side surface of the bearing boss and an inner surface of the casing disposed about the bore of the casing to hinder transfer of heat energy to the bearing boss.

15. The assembly of claim 1 wherein the casing comprises ribs that extend into the cavity.

16. The assembly of claim 15 wherein the ribs of the casing increase path length of lubricant flow in the cavity.

17. The method of claim 14 wherein the casing comprises ribs that extend into the cavity.

18. The method of claim 17 wherein the ribs of the casing increase path length of lubricant flow in the cavity.

* * * * *